US009096294B1

(12) United States Patent
Dong et al.

(10) Patent No.: US 9,096,294 B1
(45) Date of Patent: Aug. 4, 2015

(54) TROLLEY-PAYLOAD INTER-SHIP TRANSFER SYSTEM

(75) Inventors: Qing Dong, Birdsboro, PA (US); Donald D. Dalessandro, Williamstown, NJ (US); Albert Ortiz, Chalfont, PA (US); Saroj K. Biswas, Voorhees, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 427 days.

(21) Appl. No.: 13/164,172

(22) Filed: Jun. 20, 2011

(51) Int. Cl.

| | |
|---|---|
| ***B66C 13/18*** | (2006.01) |
| ***B63B 27/32*** | (2006.01) |
| ***B66C 21/00*** | (2006.01) |
| ***B66C 13/06*** | (2006.01) |

(52) U.S. Cl.
CPC ..... *B63B 27/32* (2013.01); *B66C 13/063* (2013.01); *B66C 21/00* (2013.01)

(58) Field of Classification Search
CPC .... B66C 13/06; B66C 13/063; B66C 19/002; B66C 21/00; B63B 27/18
USPC ..... 212/273–275, 281, 308, 83, 91, 97, 212/328, 330, 346
See application file for complete search history.

(56) References Cited

U.S. PATENT DOCUMENTS

| | | | | | |
|---|---|---|---|---|---|
| 456,326 | A | * | 7/1891 | Hill | 212/87 |
| 661,318 | A | * | 11/1900 | Nelson | 414/141.7 |
| 685,056 | A | * | 10/1901 | Norris | 212/84 |
| 700,321 | A | * | 5/1902 | French | 212/313 |
| 752,441 | A | * | 2/1904 | Delaney | 212/96 |
| 865,778 | A | * | 9/1907 | Hall | 212/104 |
| 879,744 | A | * | 2/1908 | Cooper | 212/104 |
| 967,353 | A | * | 8/1910 | Eoton | 212/83 |
| 1,009,930 | A | * | 11/1911 | Robertson | 212/76 |
| 1,076,599 | A | * | 10/1913 | Miller | 104/114 |
| 1,502,997 | A | * | 7/1924 | Marrian et al. | 212/313 |

(Continued)

OTHER PUBLICATIONS

Albert Ortiz, Qing Dong, Saroj Biswas, and Donald Longo, "UNREP with Minimum Payload Pendulation in Random Sea States," ASNE, Automation and Controls (ACS) 2007 Proceedings, American Society of Naval Engineers (ASNE), Biloxi, Mississippi, Dec. 10-11, 2007.

(Continued)

*Primary Examiner* — Emmanuel M Marcelo
*Assistant Examiner* — Michael Gallion
(74) *Attorney, Agent, or Firm* — Howard Kaiser

(57) ABSTRACT

The present invention is particularly efficacious when practiced as a system for transferring payloads between sideways-adjacent vessels at sea. As typically embodied, an inventive inter-locational transfer system includes: a trolley; a set of parallel cable-rails upon and along which the trolley is rollable; a pair of pulling cables, respectively connected to the two sideways-adjacent ships, for exerting pulling forces on the trolley in opposite directions along the cable-rails; at least four hoisting cables, separately and distantly attached at the bottom of the trolley and at peripheral points of the payload, for suspending a rectangular payload (e.g., ISO container with contents) from the trolley; a first computer control capability; for controlling the impelling and restraining of the trolley by the respective pulling cables; and, a second computer control capability, for controlling the lengthening and shortening of the respective hoisting cables in a coordinated manner to reduce or minimize payload pendulation.

20 Claims, 16 Drawing Sheets

(56) References Cited

U.S. PATENT DOCUMENTS

| | | | | |
|---|---|---|---|---|
| 2,351,727 | A * | 6/1944 | Wehr | 212/331 |
| 2,942,740 | A * | 6/1960 | Pristach | 414/138.4 |
| 3,012,518 | A * | 12/1961 | Sawyer et al. | 104/114 |
| 3,247,974 | A * | 4/1966 | Dechantsreiter | 414/591 |
| 3,312,452 | A * | 4/1967 | Butler et al. | 254/274 |
| 3,467,263 | A * | 9/1969 | Yendrich, Jr. et al. | 414/141.5 |
| 3,500,764 | A * | 3/1970 | Warman | 104/114 |
| 3,606,256 | A * | 9/1971 | Ovretveit | 254/275 |
| 3,675,786 | A * | 7/1972 | Wilson | 212/291 |
| 3,675,794 | A * | 7/1972 | Ingram et al. | 414/138.3 |
| 3,702,124 | A * | 11/1972 | Highland | 182/14 |
| 3,707,922 | A * | 1/1973 | Dillon | 104/114 |
| 3,710,726 | A * | 1/1973 | Buchholz et al. | 104/112 |
| 3,720,400 | A * | 3/1973 | Potts | 104/114 |
| 3,787,031 | A | 1/1974 | Lucas | |
| 3,788,491 | A * | 1/1974 | Stone | 104/178 |
| 3,820,663 | A * | 6/1974 | Junes | 212/99 |
| 3,828,683 | A * | 8/1974 | Lehrer | 104/114 |
| 3,828,940 | A * | 8/1974 | Cooper | 212/308 |
| 3,837,503 | A * | 9/1974 | Komatsu | 212/83 |
| 3,842,986 | A * | 10/1974 | Hupkes | 212/330 |
| 3,896,938 | A * | 7/1975 | Eich et al. | 212/279 |
| 3,945,508 | A * | 3/1976 | Colin | 414/138.4 |
| 3,971,545 | A * | 7/1976 | Warman | 254/273 |
| 3,976,202 | A * | 8/1976 | Bauvin | 212/322 |
| 4,014,516 | A * | 3/1977 | Jacks | 254/134.5 |
| 4,039,086 | A * | 8/1977 | Ray | 212/278 |
| 4,163,480 | A * | 8/1979 | Highland | 182/14 |
| 4,305,513 | A * | 12/1981 | Voelz | 212/276 |
| D274,320 | S * | 6/1984 | Kelly | D12/37 |
| 4,500,004 | A | 2/1985 | Peters et al. | |
| 4,531,647 | A * | 7/1985 | Higuchi et al. | 212/274 |
| 4,563,030 | A * | 1/1986 | Makino | 294/81.4 |
| 4,629,079 | A | 12/1986 | Peters et al. | |
| 4,641,587 | A * | 2/1987 | Dalliard | 105/3 |
| 4,666,127 | A * | 5/1987 | Allen | 254/281 |
| 4,750,430 | A * | 6/1988 | Morton et al. | 104/114 |
| 4,754,886 | A * | 7/1988 | Hirano | 212/76 |
| 4,784,420 | A * | 11/1988 | Makino et al. | 294/81.4 |
| 4,905,848 | A * | 3/1990 | Skjonberg | 212/274 |
| 5,020,443 | A * | 6/1991 | Gauthier | 104/230 |
| 5,107,997 | A * | 4/1992 | Worsley | 212/89 |
| 5,127,533 | A * | 7/1992 | Virkkunen | 212/275 |
| 5,350,076 | A * | 9/1994 | Kalan | 212/315 |
| 5,392,935 | A * | 2/1995 | Kazama et al. | 212/278 |
| 5,478,181 | A * | 12/1995 | Rudolf et al. | 414/140.3 |
| 5,507,596 | A * | 4/1996 | Bostelman et al. | 405/191 |
| 5,642,822 | A * | 7/1997 | Monzen et al. | 212/275 |
| 5,727,702 | A * | 3/1998 | Kullmann et al. | 212/273 |
| 5,729,453 | A * | 3/1998 | Lee et al. | 701/50 |
| 5,765,981 | A * | 6/1998 | Huang et al. | 414/140.3 |
| 5,769,250 | A * | 6/1998 | Jussila et al. | 212/274 |
| 5,819,962 | A * | 10/1998 | Okubo et al. | 212/275 |
| 6,055,924 | A | 5/2000 | Marshall et al. | |
| 6,126,023 | A * | 10/2000 | Durrant-Whyte et al. | 212/274 |
| 6,199,829 | B1 * | 3/2001 | Brown et al. | 254/134.5 |
| 6,234,332 | B1 * | 5/2001 | Monzen et al. | 212/275 |
| 6,382,437 | B1 * | 5/2002 | Okada et al. | 212/274 |
| 6,435,795 | B1 | 8/2002 | Brady | |
| 6,566,834 | B1 * | 5/2003 | Albus et al. | 318/568.2 |
| 6,631,816 | B1 * | 10/2003 | Miyazawa et al. | 212/272 |
| 6,651,577 | B1 * | 11/2003 | Gates | 114/230.23 |
| 6,809,495 | B2 | 10/2004 | Rodnunsky | |
| 6,826,452 | B1 * | 11/2004 | Holland et al. | 700/245 |
| 6,842,665 | B2 | 1/2005 | Karlen | |
| 6,886,471 | B2 | 5/2005 | Rodnunsky | |
| 6,962,091 | B2 * | 11/2005 | Lukas | 73/865.9 |
| 7,036,436 | B2 | 5/2006 | MacDonald et al. | |
| 7,127,998 | B2 | 10/2006 | MacDonald et al. | |
| 7,203,570 | B2 | 4/2007 | Karlen | |
| 7,210,589 | B2 * | 5/2007 | Iizuka | 212/273 |
| 7,267,240 | B2 * | 9/2007 | Maurer et al. | 212/270 |
| 7,308,337 | B2 * | 12/2007 | Sparenborg et al. | 700/245 |
| 7,331,477 | B2 * | 2/2008 | Schulte et al. | 212/270 |
| 7,367,464 | B1 | 5/2008 | Agostini et al. | |
| 7,413,057 | B2 | 8/2008 | Ellison, Jr. et al. | |
| 7,556,471 | B1 | 7/2009 | Gallagher et al. | |
| 7,558,645 | B2 * | 7/2009 | Shiwaku et al. | 700/245 |
| 7,559,429 | B1 * | 7/2009 | Ichimura | 212/316 |
| 7,599,762 | B2 | 10/2009 | Discenzo et al. | |
| 7,648,036 | B2 * | 1/2010 | Recktenwald et al. | 212/273 |
| 7,793,374 | B1 | 9/2010 | Anderson et al. | |
| 7,845,087 | B2 * | 12/2010 | Voecks | 33/391 |
| 7,918,354 | B2 * | 4/2011 | Shan | 212/323 |
| 7,950,539 | B2 * | 5/2011 | Henriksson | 212/274 |
| 7,963,579 | B2 * | 6/2011 | Waisanen | 294/82.12 |
| 8,195,368 | B1 | 6/2012 | Leban et al. | |
| 8,267,264 | B2 * | 9/2012 | Bryfors et al. | 212/274 |
| 8,672,288 | B2 | 3/2014 | van der Tempel et al. | |
| 2004/0206715 | A1 | 10/2004 | Rodnunsky | |
| 2005/0017228 | A1 * | 1/2005 | Werner | 254/278 |
| 2006/0180564 | A1 * | 8/2006 | Keppel | 212/330 |
| 2007/0004567 | A1 * | 1/2007 | Shetty et al. | 482/69 |
| 2007/0012642 | A1 * | 1/2007 | Imao et al. | 212/328 |
| 2007/0050115 | A1 | 3/2007 | Discenzo et al. | |
| 2007/0289931 | A1 * | 12/2007 | Henriksson | 212/274 |
| 2008/0223982 | A1 * | 9/2008 | Pri-Paz et al. | 244/33 |
| 2010/0032543 | A1 * | 2/2010 | Van Der Tempel et al. | 248/550 |
| 2013/0105430 | A1 * | 5/2013 | Ogawa et al. | 212/282 |
| 2013/0238135 | A1 * | 9/2013 | Fisher | 700/275 |
| 2014/0002297 | A1 * | 1/2014 | Collins | 342/175 |

OTHER PUBLICATIONS

Qing Dong and Saroj Biswas, "Feedback Stabilization Control of a Dual-Cable Ropeway System," Intelligent Ships Symposium VIII (Innovating Naval Ship Operation) Proceedings, American Society of Naval Engineers (ASNE), Drexel University, Philadelphia, Pennsylvania, May 20-21, 2009.

Qing Dong and Saroj Biswas, "Nonlinear Feedback Control of a Dual-Cable Ropeway System," Naval Engineers Journal, American Society of Naval Engineers (ASNE), Technical Paper, pp. 21-27, 2011.

A. M. Lytle et al., "Development of a Robotic Structural Steel Placement System," Proceedings of the 19th International Symposium on Automation and Robotics in Construction, Washington, D.C., Sep. 23-25, 2002.

Thomas Richter, Steven J. Lorenc, Leonhard E. Bernold, "Cable Based Robotic Work Platform for Construction," 1998 Proceedings of the 15th ISARC, Munchen, Germany, pp. 137-144.

Robert L. Williams II, "Novel Cable-Suspended RoboCrane Support," Industrial Robot: An International Journal, vol. 32, Issue 4, pp. 326-333, 2005; 21-page Ohio University version (online at ohio.edu) is attached.

M. H. Korayem, Kh. Najafi, M. Bamdad, "Synthesis of Cable Driven Robots' Dynamic Motion with Maximum Load Carrying Capacities: Iterative Linear Programming Approach," Transaction B: Mechanical Engineering, vol. 17, No. 3, pp. 229-239, Sharif University of Technology, Jun. 2010.

Alan Buterbaugh, Brian M. Kent, Carl Mentzer, Mark Scott, William Forster, "Demonstration of an Inverted Stewart Platform Target-Suspension System Using Lightweight, High-Tensile Strings," IEEE Antennas and Propagation Magazine, vol. 49, No. 5, Oct. 2007.

Roger V. Bostelman, James S. Albus, "Stability of an Underwater Work Platform Suspended from an Unstable Reference," Proceedings of the Oceans '93 Conference, Victoria, BC, Oct. 20, 1993.

Frederik W. Heger, Laura M. Hiatt, Brennan Sellner, Reid Simmons, Sanjiv Singh, "Results in Sliding Autonomy for Multi-Robot Spatial Assembly," Proceedings of the 8th International Symposium on Artificial Intelligence, Robotics and Automation in Space—iSAIRAS, Munich, Germany, Sep. 5-8, 2005 (ESA SP-603, Aug. 2005).

Lv Bangjun, Peng Likun, and Ming Tingtao, "Improving Dynamic Performance of Stewart Platforms through Optimal Design Based on Evolutionary Multi-Objective Optimization Algorithms," Proceedings of 2012 International Conference on Mechanical Engineering and Material Science (MEMS 2012), Atlantis Press, 2012, pp. 678-682.

"US Navy Tests Innovative Container Crane," Cranes Today Magazine website, http://www.cranestodaymagazine.com/news/us-navy-tests-innovative-container-crane/, accessed online Aug. 8, 2014 (2 pages).

(56) References Cited

OTHER PUBLICATIONS

Stephen Mraz, "Navy's New Crane Moves Load from Ship-to-Ship Despite Rolling Seas," Sep. 8, 2011, Machine Design website (http://machinedesign.com), accessed online Jul. 18, 2014 (2 pages).

"How Cable Cars Work," website of Cable Car Museum, San Francisco, http://www.cablecarmuseum.org/mechanical070714.html, accessed online Jul. 18, 2014 (1 page).

"Cable Car," Wikipedia, http://en.wikipedia.org/w/index.php?title=Cable_car&printable=yes, accessed online Jul. 18, 2014 (6 pages).

"Cable Car (Railway)," Wikipedia, http://en.wikipedia.org/w/index.php?title=Cable_car _(railway)&printable=yes, accessed online Jul. 18, 2014 (10 pages).

"Cable Railway," Wikipedia, http://en.wikipedia.org/w/index.php?title=Cable_railway&printable=yes, accessed online Jul. 18, 2014 (8 pages).

* cited by examiner

TROLLEY-PAYLOAD INTER-SHIP TRANSFER SYSTEM

BACKGROUND OF THE INVENTION

The present invention relates to transfer of payloads between two locations, more particularly to such transfer implementing a trolley in a manner suitable for carrying payloads between ships in underway replenishment operations at sea.

For many years the United States Navy has routinely engaged in "underway replenishment" ("UNREP") for ships at sea. Equipment and procedures for underway replenishment have changed little since World War II. Currently more than thirty UNREP ships are operated by the Military Sealift Command (MSC) Naval Fleet Auxiliary Force to supply/resupply the U.S. Navy's combatant fleet at sea; the UNREP ships deliver items including food, fuel, ammunition, and spare parts. U.S. Navy UNREP procedures are described by "Underway Replenishment," Naval Warfare Publication NWP 4-01.4, Department of the Navy, Office of the Chief of Naval Operations.

"Connected UNREP" typically involves use of payload transfer apparatus physically connecting two side-by-side marine vessels. Even today, "connected UNREP" tends to require excessive time and manpower. For instance, up to twenty-five sailors may be needed to handle each line from a supply vessel; therefore, with two cargo and two refueling rigs, up to a hundred people on a warship can be involved in a single UNREP operation. The U.S. Navy performs dry cargo transfer between ships in a skin-to-skin configuration up to Sea State Two, albeit it is theoretically possible to moor tankers and transfer liquid cargoes in Sea States as high as Six. The Navy wishes to develop technologies permitting UNREP operations that are safer and that necessitate fewer people and less "alongside" time. See Otto, C, "Logistics Takes Higher Priority in Navy Planning," *Sea Power*, May 2001.

More specifically, it is desirable to increase the maximum weight of a highline transfer to 12,000 pounds, which is more than double the current load limit. This could greatly reduce the time required for replenishment, leaving more time for combat operations. Further, it is desirable to be able to transfer 20-foot commercial standardized containers. Further, it is desirable to permit a wider separation between replenishment ships (e.g., more than 150 feet at twelve knots), thereby increasing the safety margin in rough seas and strong winds during UNREP operations. Further, it is desirable that the UNREP systems be able to carry the load and move it to the required position as fast and accurately as possible, with the smallest amount of load swing (pendulation).

Notably difficult for computer-controlled operation of UNREP systems is the simultaneous control of the swing and the end-point positioning of the payload. Because of the nature of a traditional ship-to-ship replenishment configuration, there is no direct control over the position of the payload; this makes it difficult to control the payload, especially insofar as reducing the swing of the payload. According to manual operation, a human operator attempts to maneuver the load to minimize the load swing. However, according to computer-controlled operation, the payload-control problem is significant due to complexity of the system model, difficulties in measuring the payload motion, and unknown disturbances due to sea waves. Pendulation control of UNREP systems has been a subject of considerable research and development for over thirty years. Described immediately hereinbelow by way of background are some efforts that have been made in this regard.

The High-Capacity Alongside Sea Base Sustainment (HiCASS) intends to address the feasibility issues related to a substantial through-put rate capability and reliable delivery of material in up to Sea State Five. See S. Kery et al., "Achieving High Container Through-Put Rates between Vessels in High Seas (a Vision of HiCASS)," Proceedings of MTS/IEEE, 2005, Oceans, Volume 1, pages 454-459.

Rolls-Royce proposed to develop an integrated technology solution for HiCASS in heavy seas using advanced sensing and measuring technologies. See Rolls-Royce, "Coming Alongside Speeds up String at Sea," In-Department, Issue 7, 2000.

Oceaneering International, Inc. proposed a technology demonstration that integrated innovations in ship motion prediction measured wave fields, fendering, crane configurations and actuation methods, controls, sensors, and simulation technologies. See Oceaneering Technologies (OTECH), "High Capacity Alongside Sea Base Sustainment (HiCASS)," http://www.oceaneering.com/brochures/Pdfs/hicass.pdf.

Lockheed Martin demonstrated in a virtual simulation environment a HiCASS capability employing enabling technologies to ensure safe and expeditious ship approach, connection of ships, minimization of relative motion between the ships, dynamic handling of the moored-ship assembly, and separation of the ships in open ocean environment and in sea states up to and including Sea State Five.

A simple Proportional-plus-Derivative (PD) type output feedback control has been proposed for a rotary crane described by a nonlinear model. See B. Kiss, "A Simple Output Feedback PD Controller for Nonlinear Cranes," IEEE Conference on Decision Control, 2000.

A Lyapunov-type approach based on back-stepping method has been used to control a two-degrees-of-freedom overhead crane along a desired trajectory. See S. C. Martindale, "Approximate Nonlinear Control for a Two Degree of Freedom Overhead Crane: Theory and Experimentation", Proceedings of the American Control Conference, June 1995.

Isidori solved the problem of controlling a nonlinear plant in order to have its output track a reference signal. See A. P. Isidori, "Output Regulation for Nonlinear System: an Overview," International Journal of Robust Nonlinear Control, Volume 10, pages 323-337, 2000.

Vikramaditya developed a nonlinear controller for the overhead crane system using a Lyapunov function and a modified version of sliding-surface control. See B. Vikramaditya, "Nonlinear Control of a Trolley Crane System," American Control Conference, Chicago, Ill., June 2000.

In general, for systems with flexible cables, it is important that partial differential equations be used as the system model. D'Andrea-Novel et al. used a hybrid model combining ordinary and partial differential equations to represent the trolley motion and the cable oscillations, and proved exponential stabilization under infinite dimensional settings using simple boundary feedback. See B. D'Andrea-Novel et al., "Feedback Stabilization of a Hybrid PDE-ODE System: Application to an Overhead Crane," Mathematics of Control, Signals, and Systems, Volume 7, pages 1-22, 1994.

Conrad et al. similarly disclose strong stability results, and use a more detailed and accurate model of a trolley-cable system. See F. Conrad et al., "Strong Stability of a Model of an Overhead Crane," Control and Cybernetics, Volume 27, pages 363-374, 1998.

Joshi et al. investigated modal analysis of cable motions, starting with a hybrid ordinary differential equation–partial differential equation model. See S. Joshi et al., "Position Control of a Flexible Cable Gantry Crane: Theory and Experiment," Proceedings of the 1995 American Control Conference, Volume 4, pages 2820-2824, 1995.

A simple feedback control system has been presented that stabilizes several dominant modes of oscillations. Todaka et al. disclose use of $H_\infty$ control theory to provide good performance, even in the presence of modeling errors and parameter variations. See Yuji Todaka et al., "The Control System Design of a Traveling Crane Using $H_\infty$ Control Theory," SICE 2002 Session Schedule, IEEE, 2000.

Beliveau et al. disclose a decoupling controller in which a control yoke is located at the cable support point. See Y. Beliveau et al., "Dynamic damping of Payload Motion for Cranes," Journal of Construction Engineering and Management, Volume 119, pages 631-644, 1993. Beliveau et al.'s method is similar to that of controlling a cable using a boundary control, and minimizes the effects of disturbances.

Lau et al. investigated the effects of trolley motion trajectories on the load pendulation, and showed that a half-sine type velocity trajectory better replicated the real world manually operated trolley velocity trajectory as compared to a trapezoidal-type trajectory. See W. S. Lau et al., "Motion Analysis of a Suspended Mass Attached to a Crane," Computers and Structures, Volume 52, pages 169-178, 1994.

Wen et al. disclose a dynamic model, using Lagrange's equation, of a shipboard crane. Wen et al.'s anti-swing control system is based on a linear quadratic regulator for minimization of load pendulation. See Bin Wen et al., "Modeling and Optimal Control Design of Shipboard Crane," Proceedings of the American Control Conference, San Diego, pages 593-597, 1999.

Masoud et al. disclose control of load oscillations using delayed feedback for loads suspended by four cables as commonly found at shipyards. See Z. Masoud et al., "Sway reduction on Container Crane Using Delayed Feedback Controller," ASME/ASC Structure, Structural Dynamics, and Materials Conference, Volume 1, pages 609-615, 2002.

Kimiaghalam et al. developed a feedback/feed-forward control system based on implicit description of a shipboard crane. See B. Kimiaghalam et al., "Feedback and Feedforward Control Law for a Ship Crane with Maryland Rigging System" Proceedings of the American Control Conference, 2000.

"RoboCrane" is a cable-driven manipulator that was invented by the Intelligent Systems Division of the National Institute of Standards and Technology (NIST). RoboCrane basically resembles an inverted Stewart platform, with cables serving as links, and winches serving as actuators. RoboCrane boasts six-degrees-of-freedom payload control, and improved load stability over traditional lift systems. See A. M. Lytle et al., "Development of a Robotic Structural Steel Placement System," Proceedings of the 19$^{th}$ International Symposium on Automation and Robotics in Construction, Washington, D.C., Sep. 23-25, 2002.

SUMMARY OF THE INVENTION

In view of the foregoing, it is an object of the present invention to provide an improved methodology for transferring payloads between ships at sea.

The present invention is typically embodied as a transport system suitable for use between ships at sea. The inventive transport system includes two highlines, a trolley, two trolley-movement cables, four hoisting cables, two trolley-movement winches, four hoisting winches, a trolley-movement-control computer, and a hoisting-control computer.

The two highlines (a left highline and a right highline) are tensioned and generally parallel, and extend between a first location (e.g., onboard a first ship) and a second location (e.g., onboard a second ship). The trolley is situated upon and movable along the highlines. The trolley has a trolley body, a left front wheel, a right front wheel, a left back wheel, a right back wheel, a front trolley end, and a back trolley end. The left front wheel and the left back wheel each rotatably engage the left highline. The right front wheel and the right back wheel each rotatably engage the right highline.

The two trolley-movement winches are respectively situated at the first location and the second location. The two trolley-movement cables are respectively associated with the trolley-control winches and are respectively connected at the front trolley end and the back trolley end. Each trolley-movement winch, together with its associated trolley-movement cable, is capable of exerting a pulling force on the trolley. The trolley-movement winches, together with their respectively associated trolley-movement cables, cooperatively act to propel the trolley along the highlines. The trolley-movement-control computer is connected to the trolley-movement winches, and is configured to execute trolley-movement-control computer program logic that, when executed, is capable of controllably motivating the trolley, in either direction, along the highlines.

The four hoisting cables are connected to the trolley body for hoisting a payload. The payload includes a container suspended from the trolley via the hoisting cables. The hoisting cables are respectively associated with the hoisting winches. Each hoisting winch, together with its associated hoisting cable, is capable of exerting a pulling force on the container. The hoisting-control computer is connected to the hoisting winches, and is configured to execute hoisting computer program logic that, when executed, is capable of controllably reducing pendulation of the payload.

The present invention, as typically embodied, provides a plural-highlines trolley-payload inter-ship transfer system. United States Navy UNREP systems are among the diverse potential applications of the present invention. For the Navy, inventive practice can represent a new and superior dynamic system for effecting ISO container transfer, doing so with greater stability than conventional transfer systems in the face of uncertain platform motion and other disruptive factors. Ship-to-ship replenishment and heavy lifting will remain important aspects of sea-basing for the foreseeable future. The present invention provides for automation and control of ship-to-ship replenishment whereby the payload remains in a stable state during transport. Positive pendulation control during UNREP cargo transfer under adverse sea conditions is becoming increasingly important in UNREP operations.

Other potential benefits of inventive practice include the following: reduced workload; increased safety (e.g., reduced risk to sailors); increased operational efficiency; obviation of sailor tag-line pulling; ship-to-ship replenishment capabilities under High Sea States; uninterrupted ship-to-ship replenishment to mission critical areas; increased fleet supportability; increased equipment reliability; increased survivability; improved wartime effectiveness.

A typical algorithm implemented in inventive practice includes two main algorithmic components, viz., (i) a payload anti-swing automation control component, and (ii) a payload position automation control component. An inventively practiced central computer can spearhead highly efficient logistic system throughput, as the central computer can perform, in short time periods, large amounts of work directed to both main algorithmic components. The present invention is typically embodied so as to afford, for instance during underway replenishment, what may be described in principle as active stabilization of a highlines-suspended "inverted Stewart platform" payload.

Various approaches to exercising trolley-movement control and hoisting control are not elaborated upon herein but have been considered by the present inventors and may be worthy of further investigation. For instance, inventive control can use predictive control strategies based on estimated arrival times of sea waves to the ship. As another example, sensor technologies can be implemented to measure wave heights and propagation velocities.

To some extent, the present invention has built upon and evolved from previous work by the present inventors, such as indicated by the following pertinent papers, each of which is hereby incorporated herein by reference: Qing Dong, Albert Ortiz, Saroj Biswas, and Donald Longo, "UNREP with Minimum Payload Pendulation in Random Sea States," ASNE, Automation and Controls (ACS) 2007 Proceedings, American Society of Naval Engineers (ASNE), Biloxi, Mississippi, 10-11 Dec. 2007; Qing Dong and Saroj Biswas, "Feedback Stabilization Control of a Dual-Cable Ropeway System," Intelligent Ships Symposium VIII (Innovating Naval Ship Operation) Proceedings, American Society of Naval Engineers (ASNE), Drexel University, Philadelphia, Pa., 20-21 May 2009; Qing Dong and Saroj Biswas, "Nonlinear Feedback Control of a Dual-Cable Ropeway System," *Naval Engineers Journal*, American Society of Naval Engineers (ASNE), Technical Paper, pages 21-27, 2011.

Other objects, advantages, and features of the present invention will become apparent from the following detailed description of the present invention when considered in conjunction with the accompanying drawings.

BRIEF DESCRIPTION OF THE DRAWINGS

The present invention will now be described by way of example with reference to the accompanying drawings, wherein like numbers indicate same or similar parts or components, and wherein:

FIG. 2 illustrates, by way of example, a basic inventive configuration of side-by-side ship-to-ship transfer, inventively implementing a pair of highwire cables joined at their opposite ends to the ships, a trolley riding on the highwire cables, a pair of generally co-linear hauling (trolley-pulling) cables respectively based on the ships and attached at opposite ends of the trolley, and four hoisting cables suspended from the trolley and attached at their bottom ends to a rectangular prismatic container of cargo.

FIG. 16 through FIG. 21 are illustrative of how inventive practice can vary in terms of the plural number of trolley wheels and/or the plural number of highwire cables that the trolley sits/rides upon.

DESCRIPTION OF EXEMPLARY EMBODIMENTS OF THE INVENTION

Figure 1:
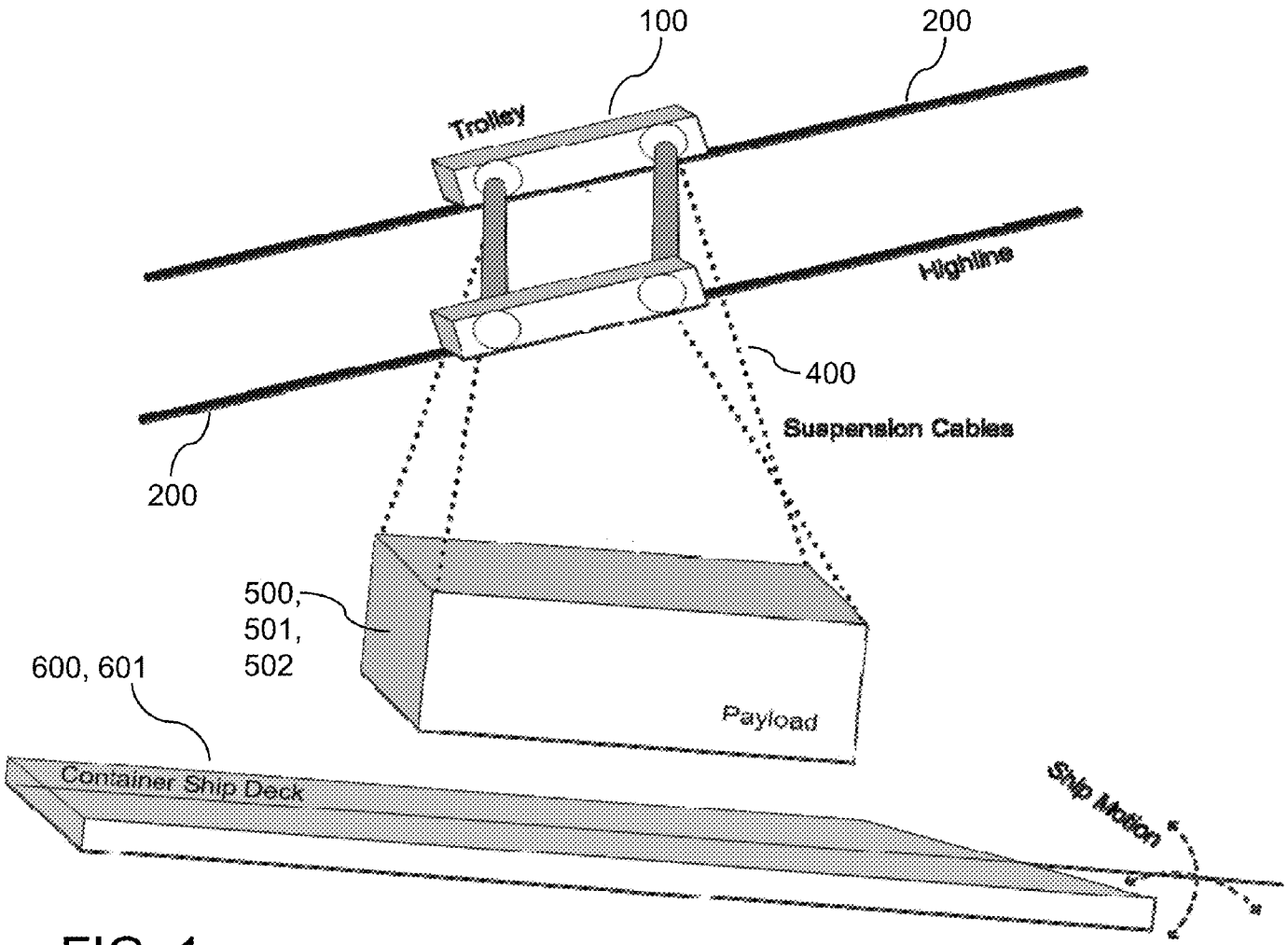
FIG. 1 is a partial, perspective, conceptual view of an embodiment of a transfer system in accordance with the present invention.
Figure 2:
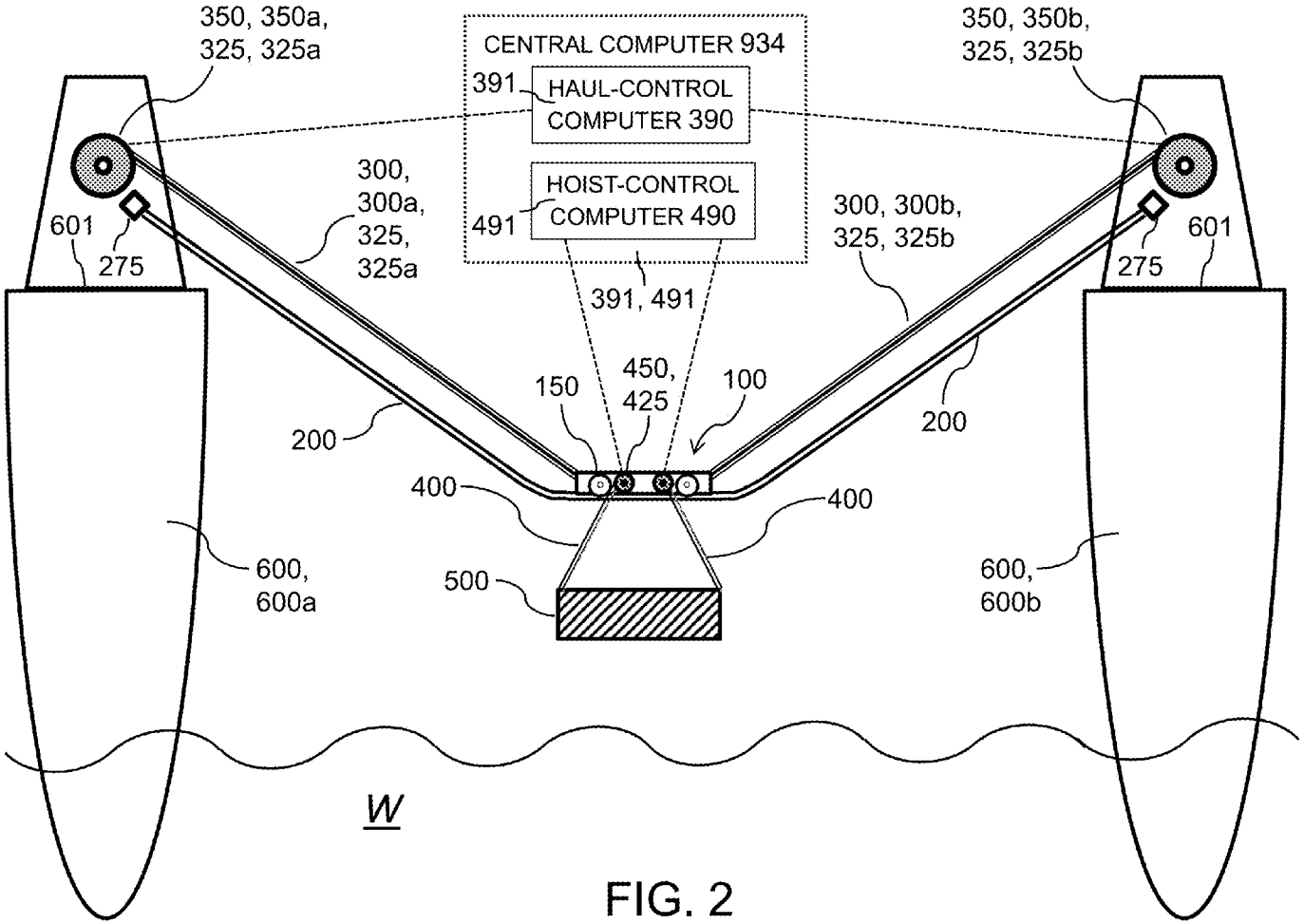
FIG. 2 is a diagrammatic side ("highwires-wise") elevation view of an embodiment of an inventive transfer system similar to that shown in FIG. 1.
Figure 3:
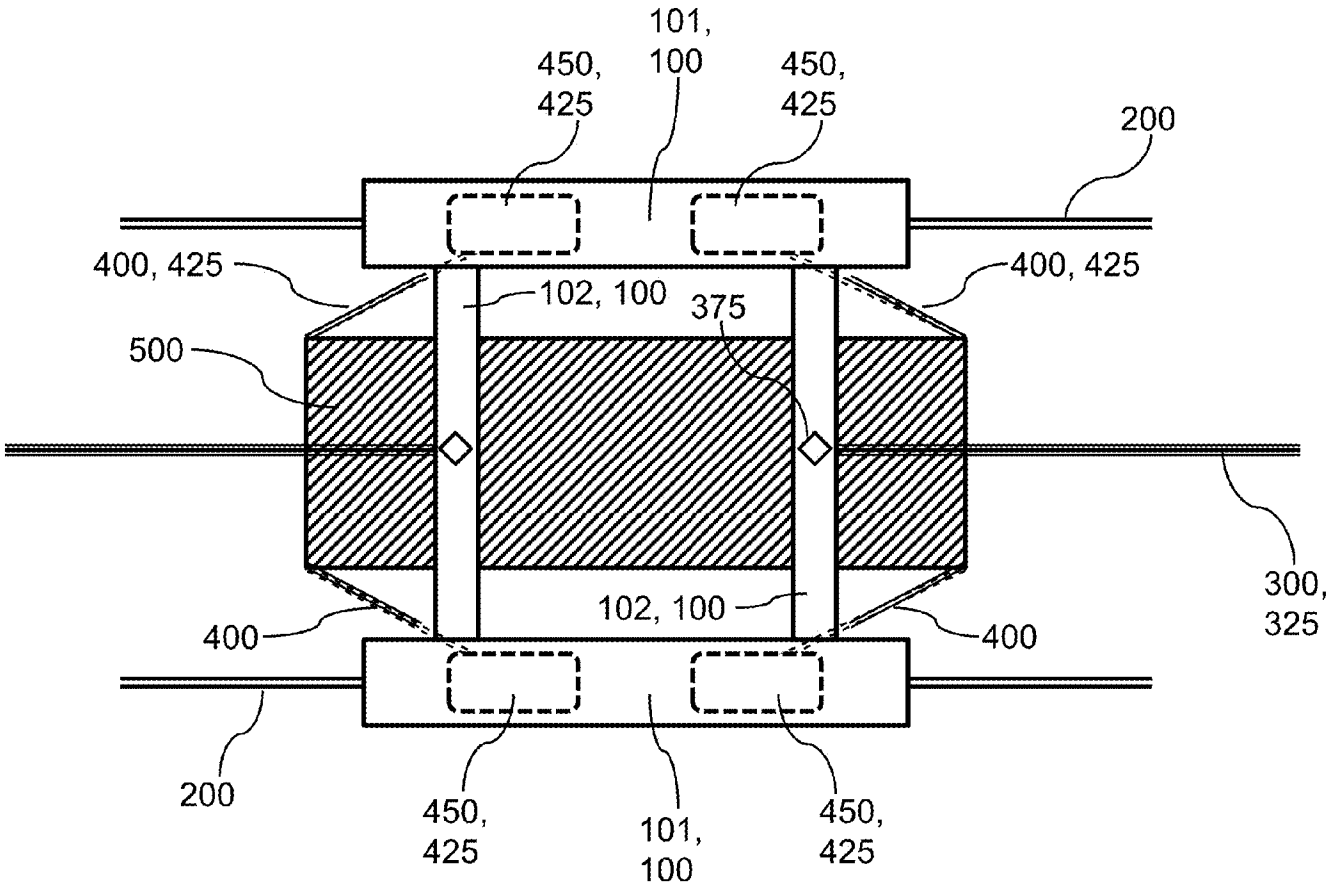
FIG. 3 is a partial, top plan view of an inventive embodiment of a trolley riding on highwire cables and being pulled in either longitudinal (inter-ship) direction by the hauling cables, such as illustrated in FIG. 2.
Figure 4:
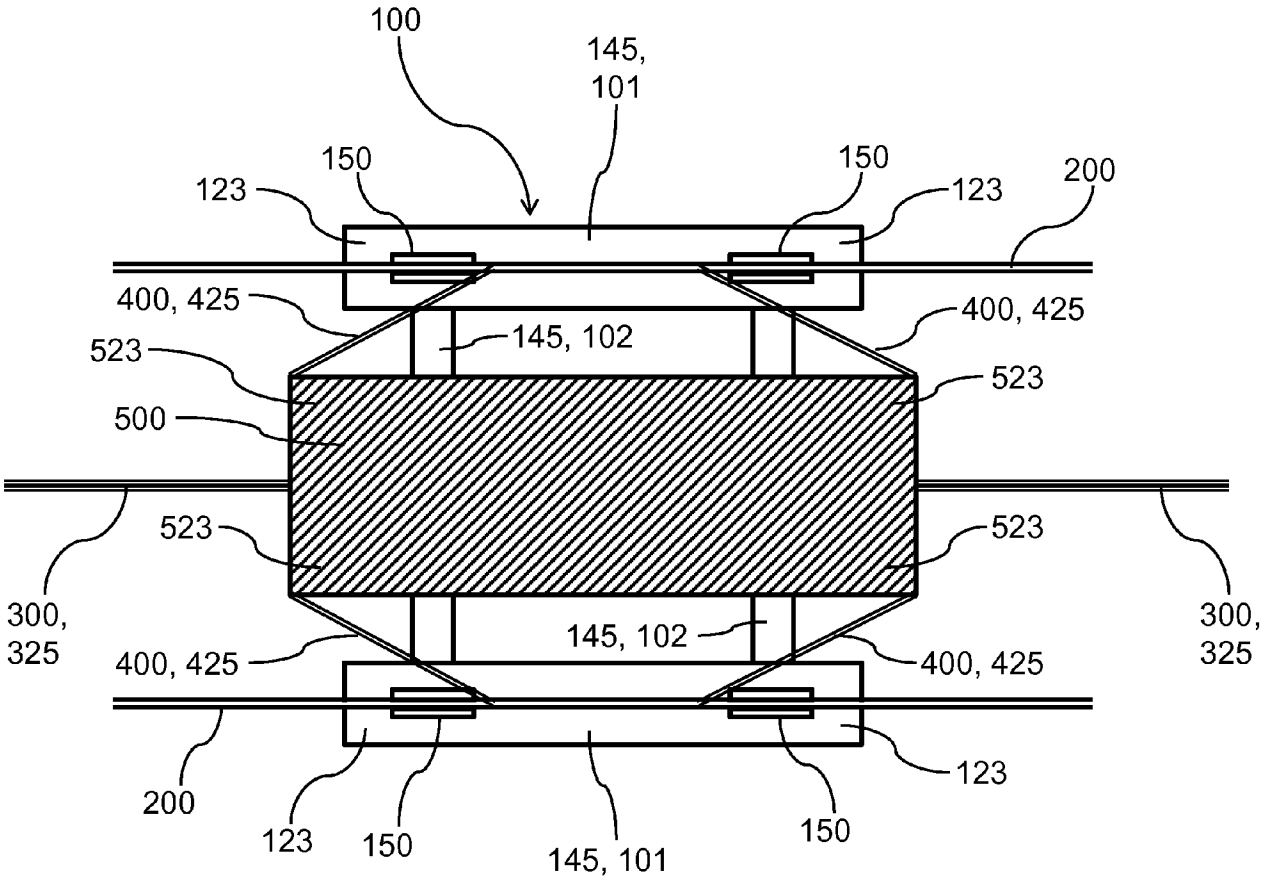
FIG. 4 is a partial, bottom plan view of the inventive embodiment depicted in FIG. 3.
Figure 5:
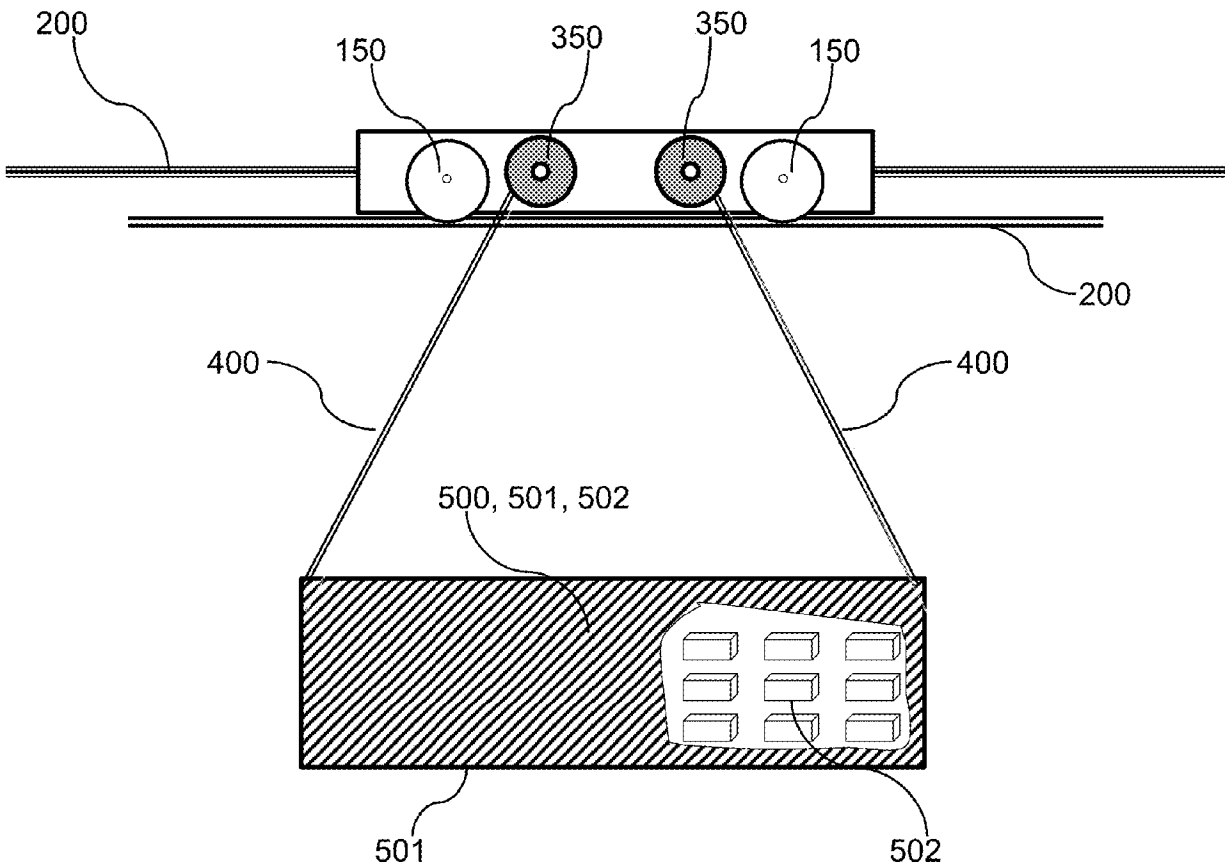
FIG. 5 is a partial, side elevation view (looking perpendicular to the general travel direction of the trolley) of the inventive embodiment depicted in FIG. 3.

Referring now to FIG. 1 through FIG. 9, the present invention's transfer system includes a trolley 100, two high lines (alternatively spelled herein "highlines") 200, two haul (pull) lines 300, and four hoist (suspension) lines 400. As shown in FIG. 2, two waterborne ships 600—viz., a source ship 600*a* and a destination ship 600*b*—each having a ship deck 601, are side-by-side in a body of water W, and are engaging in a transfer of cargo from one ship 600 to the other. With some approximation, the two high-lines 200 are parallel and vertically even.

The terms "source ship" and "destination ship" are used herein to conveniently distinguish the two ships participating in the transfer; nevertheless, it is to be understood that inventive practice provides for bidirectional transfer of objects, i.e., either from source ship 600*a*'s deck 601 to destination ship 600*b*'s deck 601, or from destination ship 600*b*'s deck 601 to source ship 600*a*'s deck 601.

Although four hoist lines are shown herein in some figures and six hoist lines are shown herein in others, it is emphasized that practically any number of hoist lines greater than two can be used in inventive practice. Typically, inventive practice will balance the attachment points of the hoist lines about a geometric center (or geometric vertical axis). For instance, three hoist lines can be inventively utilized efficaciously whereby they are spaced apart 120 degrees in an equiangular (equilateral) triangular configuration.

Trolley 100 includes a trolley body 145 and four wheels 150. Trolley body 145 includes two longitudinal trolley sections 101 and two transverse trolley sections 102. Trolley body 145 is characterized by an approximately rectangular plan profile and four trolley corners 123. Frequent inventive practice provides a square geometric plan shape of trolley body 145, such as square s shown in FIG. 6. Each of two pairs of wheels 150 is aligned so as to share a rotational geometric wheel axis such as axis a shown in FIG. 6. Depending on the inventive embodiment, either or both pairs of wheels 150 can function mechanically either coaxially or independently.

Figure 15:
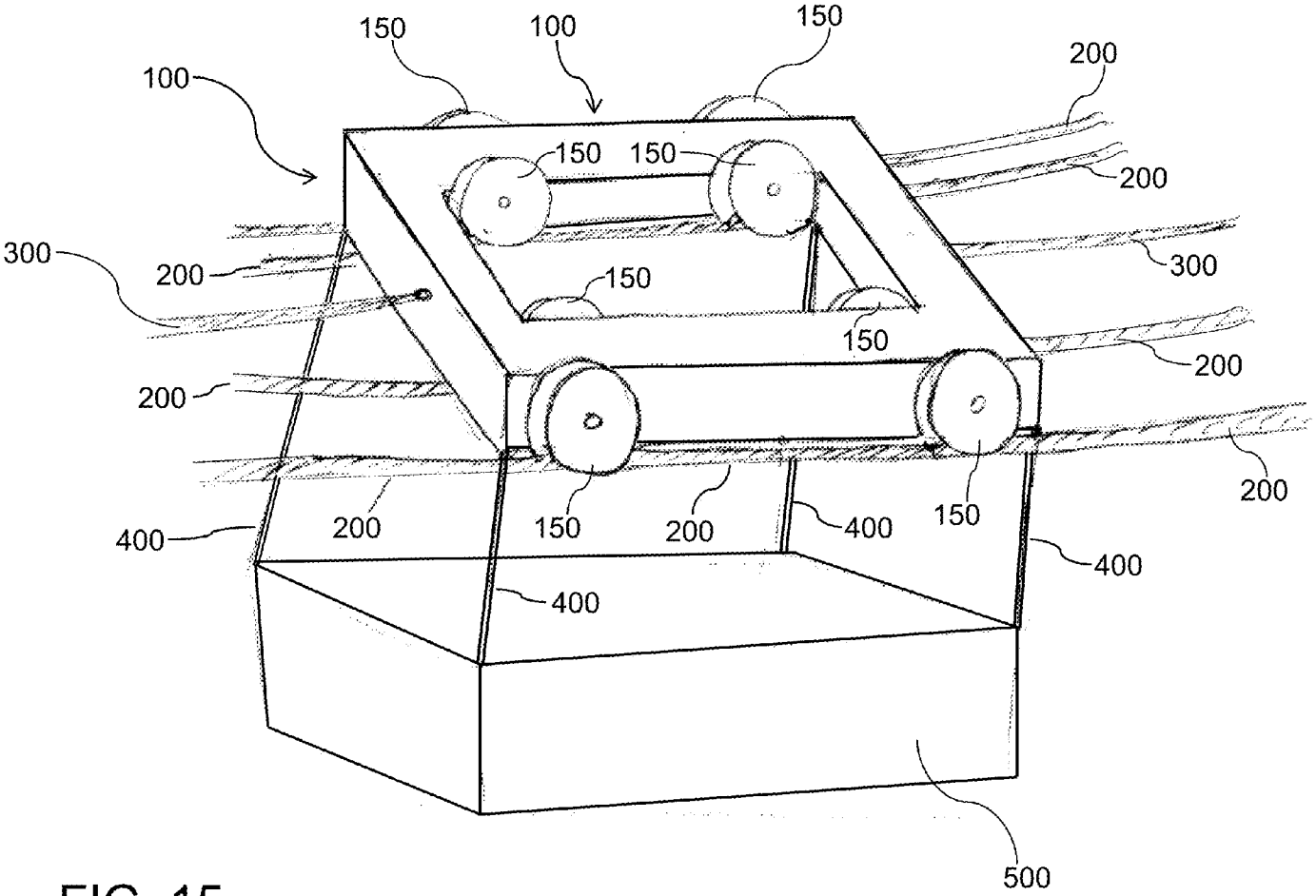
FIG. 15 is a partial perspective view of another embodiment of a transfer system in accordance with the present invention. Similar to the inventive embodiment shown in FIG. 3, the inventive embodiment shown in FIG. 15 has four hoisting cables. However, unlike the inventive embodiments shown in FIG. 3 and FIG. 10, which each ride on two highlines, the inventive embodiment shown in FIG. 15 rides on four highlines.

The number of wheels 150 is variable in inventive practice. Further, the number of highlines 200 is variable in inventive practice. For instance, FIG. 15 shows a trolley having eight wheels 150 arranged in two sets of four coaxial wheels 150. The embodiment shown in FIG. 15 of an inventive system has a total of four highlines 200, each of four pairs of front and back wheels 150 riding upon a highline 200.

Figure 17:
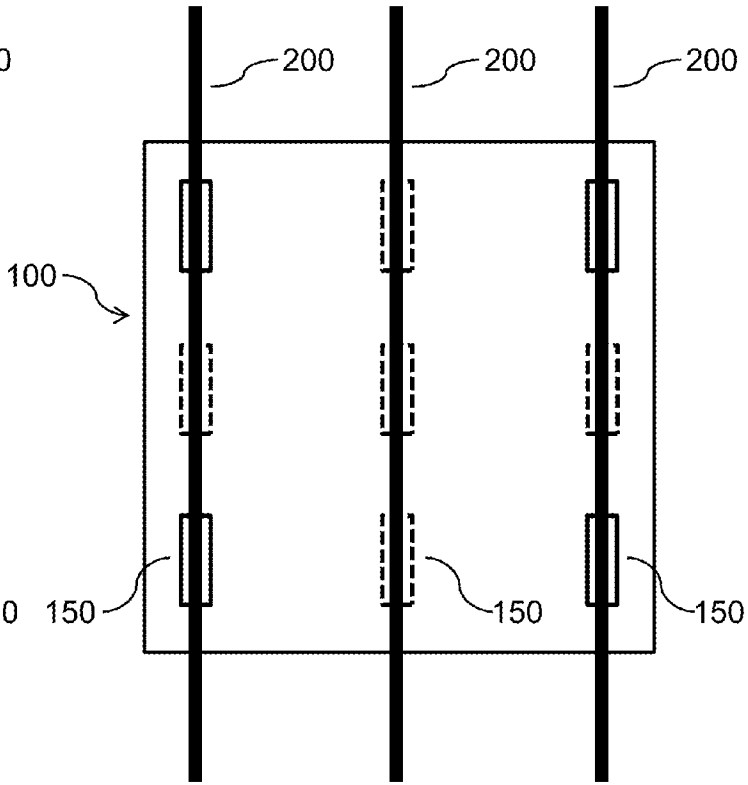
FIG. 16 through FIG. 21 represent, in similar fashion, partial, bottom plan views of various embodiments of a transfer system in accordance with the present invention.
Figure 16:
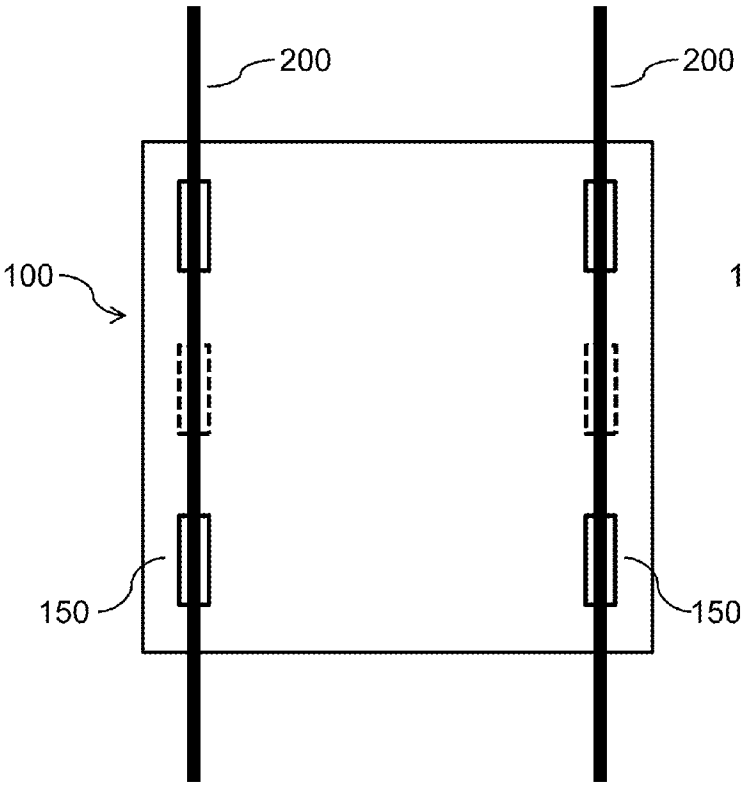
Figure 19:
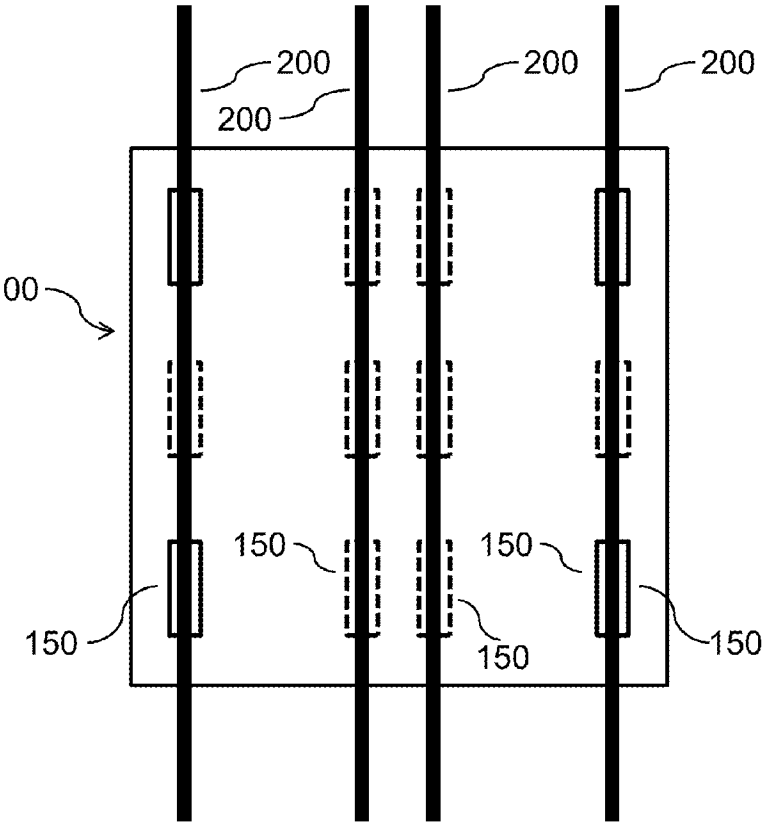
Figure 18:
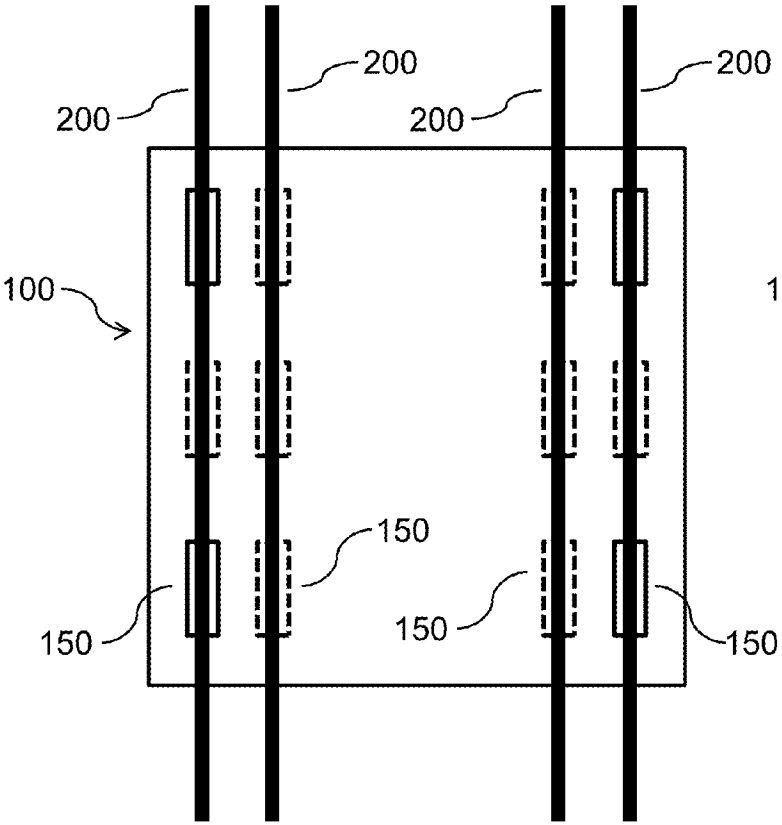
Figure 21:
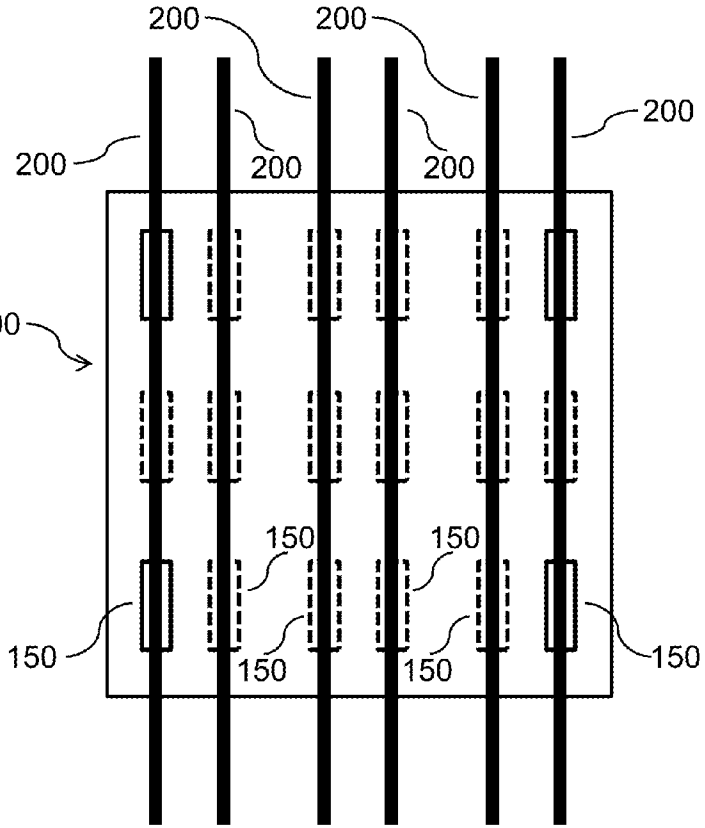
Figure 20:
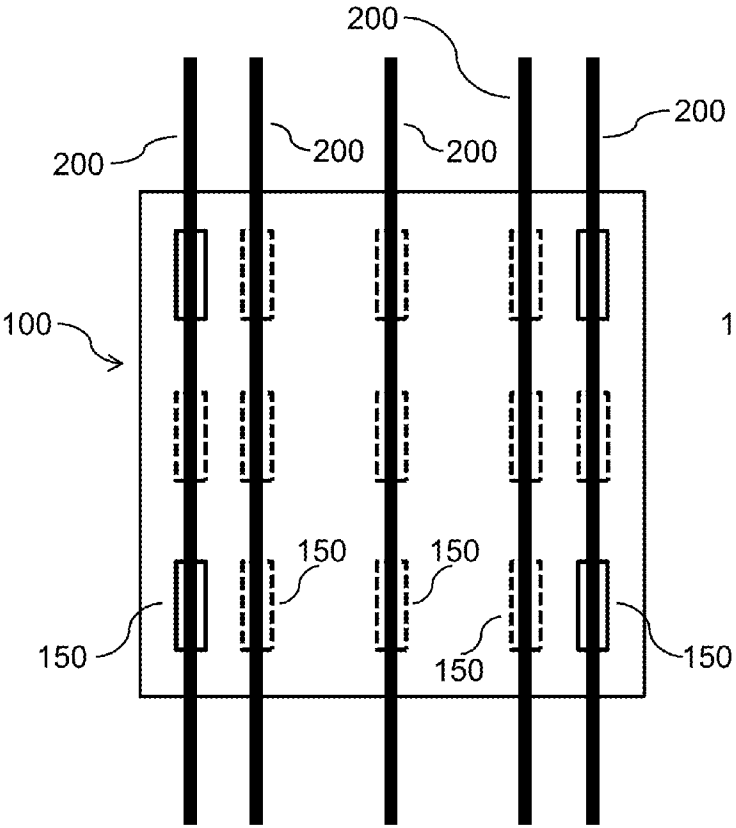

FIG. 16 through FIG. 21 illustrate how the numbers of trolley wheels and/or highlines can vary, depending on the inventive embodiment. FIG. 16 shows how four or more wheels can be used with two highlines. Similarly, FIGS. 17-21 show how numbers of highlines can vary for different numbers of highlines. FIG. 17 shows three highlines. FIG. 18 shows four highlines. FIG. 19 shows four highlines configured differently than shown in FIG. 18. FIG. 20 shows five highlines. FIG. 21 shows six highlines. FIGS. 16-21 merely provide examples, as multifarious other combinations and configurations of trolley wheels and highlines are possible in inventive practice.

As illustrated in FIG. 2, the two high lines 200 are respectively attached at opposite ends to two high-line-to-ship fasteners 275, one on each ship 600. The inventive arrangement shown in FIG. 2 bears some resemblance to a traditional cantilever bridge, which has two beam-like parts that meet in the middle and that are supported at their far ends. The pair of highlines 200 is forced downward by the weight of trolley 100. FIG. 2 shows trolley 100 approximately equidistant between high-line-to-ship fasteners 275, with the pair of highlines 200 describing a kind of bottom-truncated "V"-shape, the V's bottom truncation corresponding to the longitudinal dimension of trolley 100.

Figure 6:
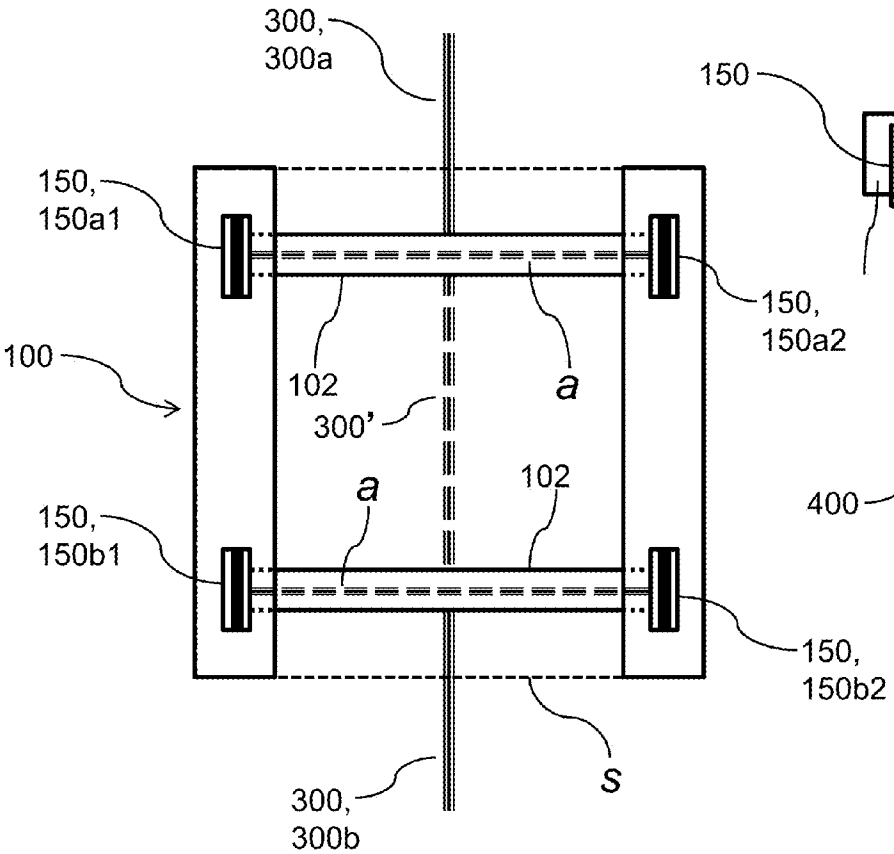
FIG. 6 is a partial, bottom plan view of the trolley and hauling cables of the inventive embodiment depicted in FIG. 3.
Figure 9:
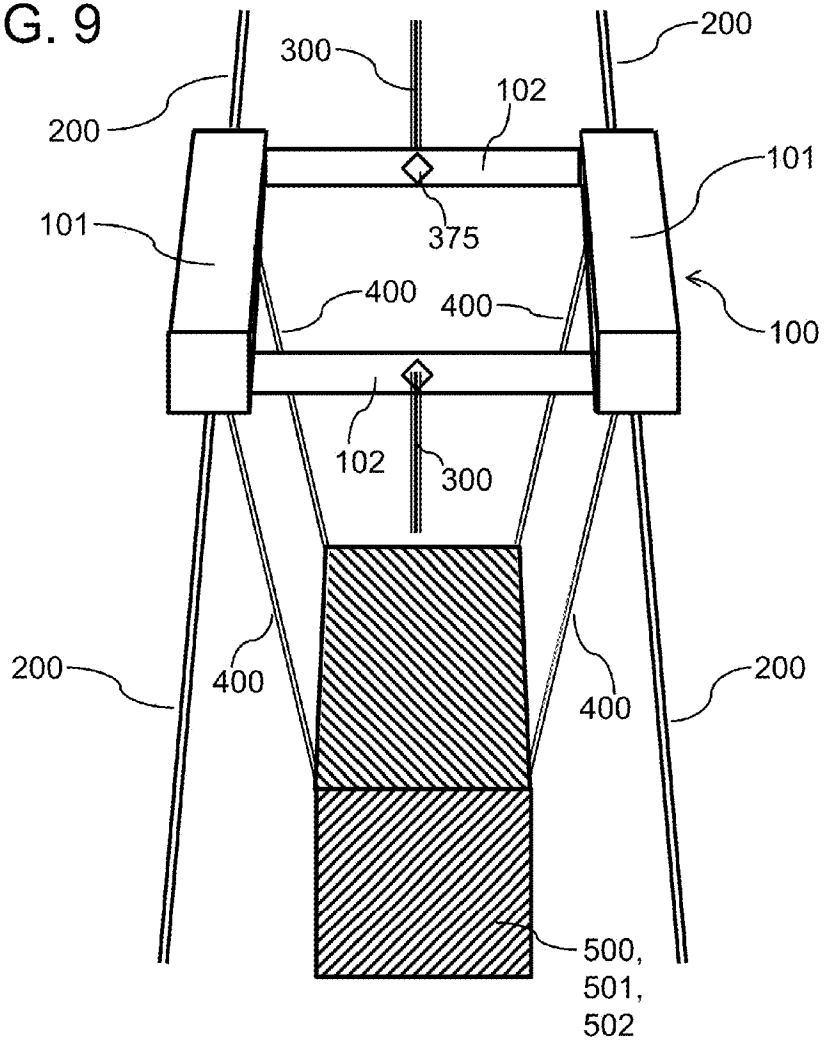
FIG. 9 is a partial, downward perspective end view, similar to the view of FIG. 7, of the inventive embodiment depicted in FIG. 3.
Figure 8:
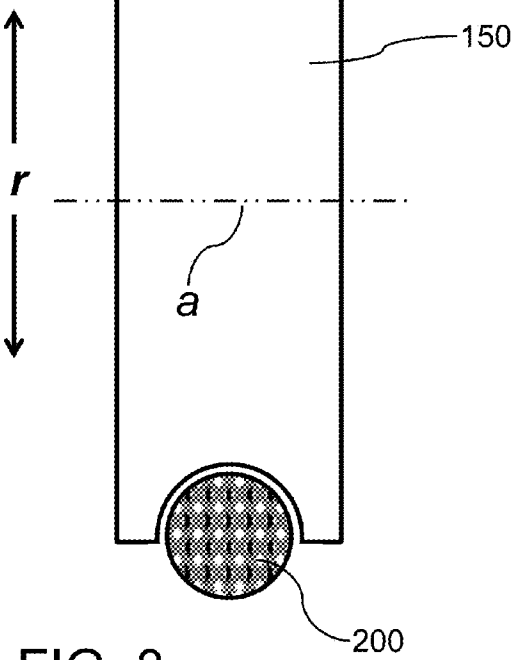
FIG. 8 is a view, edge-on with respect to a trolley wheel and cross-sectional with respect to a highwire cable, illustrating the trolley wheel rolling atop and along the highwire cable.

Two separate haul (pull) lines 300, viz., 300*a* and 300*b*, are respectively attached at opposite (front and back) ends of trolley 100, each haul line 300 serving to pull in the direction of the ship deck 601 with which it is connected. Some inventive embodiments provide for a continuous bidirectional haul line 300' (incl. 300*a* and 300*b*) such as shown in FIG. 6. Each of two haul winching mechanisms 325 includes a haul line 325 and a haul line winch 350.

Haul winching mechanisms 325*a* includes a haul line 325*a* and a haul line winch 350*a*. Haul winching mechanisms 325*b* includes a haul line 325*b* and a haul line winch 350*b*. Haul line winch 350*a* is situated on deck 601 of ship 600*a*. Haul line winch 350*b* is situated on deck 601 of ship 600*b*. As viewed in FIG. 2, haul line 325*a* is winched at its outer end by haul winching mechanism 325*a* and is attached at its inner end to trolley 100 via a haul-line-to-trolley fastener 375; similarly, haul line 325*b* is winched at its outer end by haul winching mechanism 325*a* and is attached at its inner end to trolley 100 via a haul-line-to-trolley fastener 375.

The present invention is frequently practiced whereby payload 500 includes a container 501 and cargo 502, inside container 501. The skilled artisan who reads the instant disclosure understands that the present invention can be practiced in association with a variety of payloads.

Electrical connections between computer control components and inter-ship transfer components, in accordance with the present invention, are shown by way of example in FIG. 2. Haul-control computer 390 has, resident in its memory, haul-control computer software 391. Hoist-control computer 490 has, resident in its memory, hoist-control computer software 491. Haul-control computer 390 communicates with haul line winches 350*a* and 350 *b*. Hoist-control computer 490 communicates with hoist line winches 450.

Inventive practice admits of implementation of a central computer 934, which houses, contains, or incorporates the two computers 390 and 490; however, collocation or sharing of computer means (e.g., sharing the same computer hardware) for the various forms of inventive control is not necessary in inventive practice. The skilled artisan who reads the instant disclosure understands that haul-control computer 390 and hoist-control computer 490 can share the same computer hardware, or can correspond to different computer hardware at the same or different locations. The semantic distinction herein between "haul-control computer 390" and "hoist-control computer 490" primarily conveys that a first computer means is directed to executing haul-control computer program logic 391, and that a second computer means—same as, connected to, disconnected from, or different from the first computer means—is directed to executing hoist-control computer program logic 491.

Haul winches 450, together with their respectively associated haul cable 300, cooperatively act to propel trolley 100 along highlines 200 between two locations, either: (i) away from the first location (e.g., ship 600*a*) and toward the second location (e.g., ship 600*b*); or, (ii) away from the second location (e.g., ship 600*b*) and toward the first location (e.g., ship 600*a*). Haul-control computer 390 is configured to execute haul-control computer program logic 391 that, when executed, is capable of controllably motivating trolley 100 along highlines 200 between the first location and the second location.

According to computer program logic 391, if the pulling force exerted by haul winch 350*b* (situated at the second location) is substantially in the nature of a motivating force, then the pulling force exerted by haul winch 350*a* (situated at the first location) is substantially in the nature of a restraining force. If the pulling force exerted by haul winch 350*a* (situated at the first location) is substantially in the nature of a motivating force, then the pulling force exerted by haul winch 350*b* (situated at the second location) is substantially in the nature of a restraining force.

Figure 7:
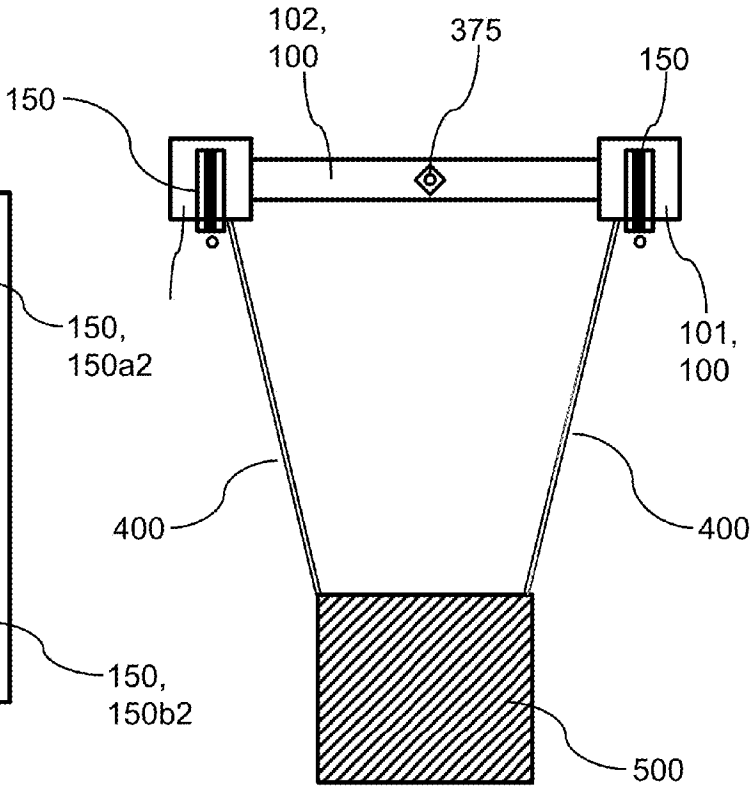
FIG. 7 is a partial, end elevation view (looking in the general travel direction of the trolley) of the inventive embodiment depicted in FIG. 3.

FIG. 6 of the aforementioned paper by Qing Dong and Saroj Biswas, "Feedback Stabilization Control of a Dual-Cable Ropeway System," and FIG. 7 of the aforementioned paper by Qing Dong and Saroj Biswas, "Nonlinear Feedback Control of a Dual-Cable Ropeway System," are the same graph illustrating control applied on haul cables in the systems respectively disclosed therein. Principles of that graph in those references are applicable to practice of the present invention. Notable is how the exertion of pulling force exerted at both ends shifts in accordance with the progress of the trolley traveling on the track cable. In the downward phase in the trolley's journey, the pulling from the first end generally acts to restrain the trolley. Then, in the upward phase in the trolley's journey, the pulling from the second end, generally representing greater force than the pulling in the downward phase, generally acts to move the trolley.

The terms "line" and "cable" are used interchangeably herein in referring to the present invention's highlines 200, haul lines 300, and hoist lines 400. The skilled artisan who reads the instant disclosure will appreciate the various types and characteristics of lines/cables that would be suitable for inventive practice.

The combination including trolley 100, hoist lines 400, and payload 500 constitute, in essence, an inverted Stewart platform. Among the features of the present invention is an "inverted Stewart platform" principle according to which positive control may be feasible to move payloads sufficiently fast and precise under adverse sea conditions. Typical inventive practice reduces payload pendulation using an inverted Stewart platform-type mechanism concurrently with a disturbance-rejecting feedback control system. Discussed herein below are various aspects of typical inventive algorithmic control, including system modeling and controllers design.

Figure 10:
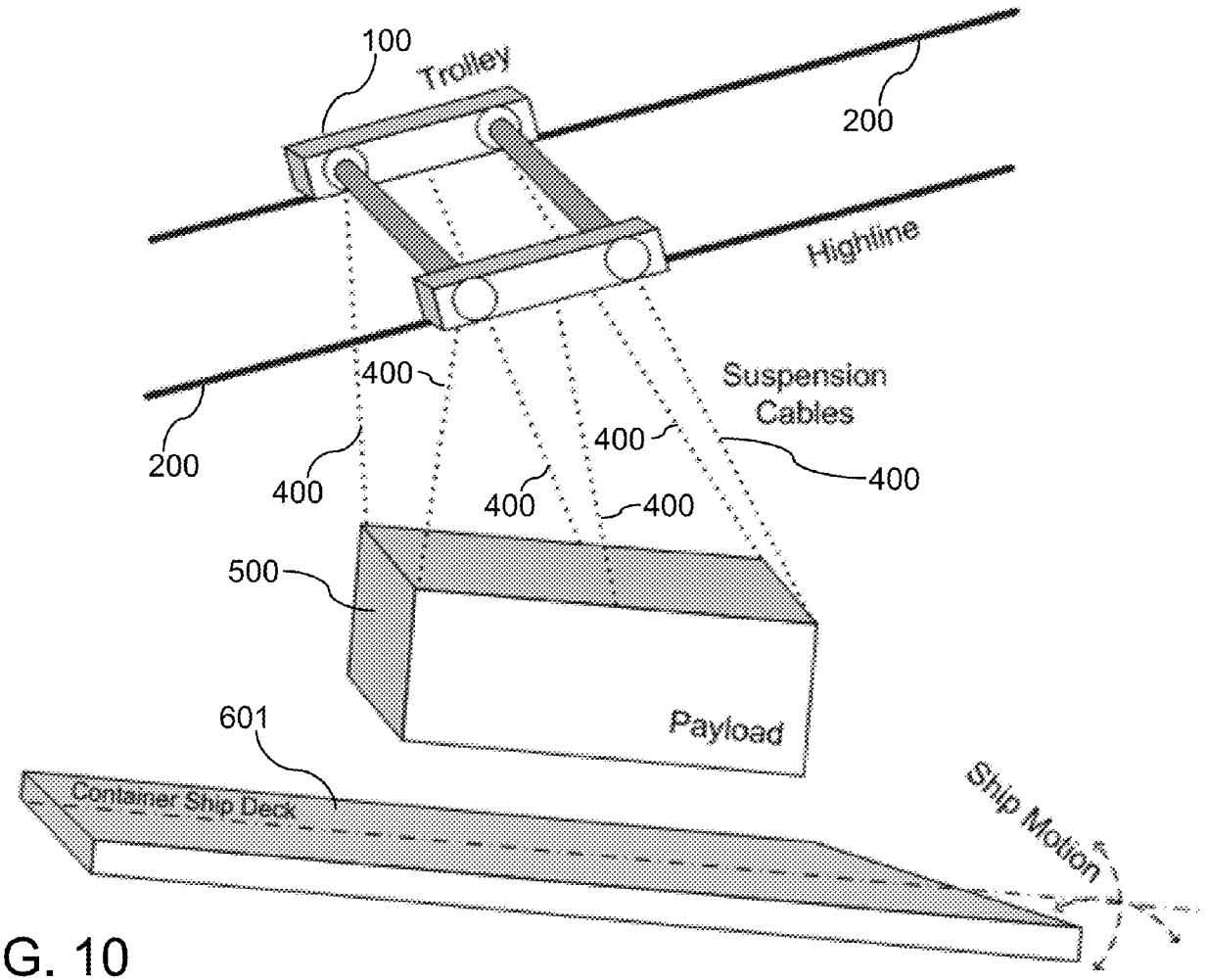
FIG. 10 is a partial, perspective, conceptual view, similar to the view of FIG. 1, of another embodiment of a transfer system in accordance with the present invention. The inventive embodiment shown in FIG. 1 has four hoisting cables, whereas the inventive embodiment shown in FIG. 10 has six hoisting cables.
Figure 11:
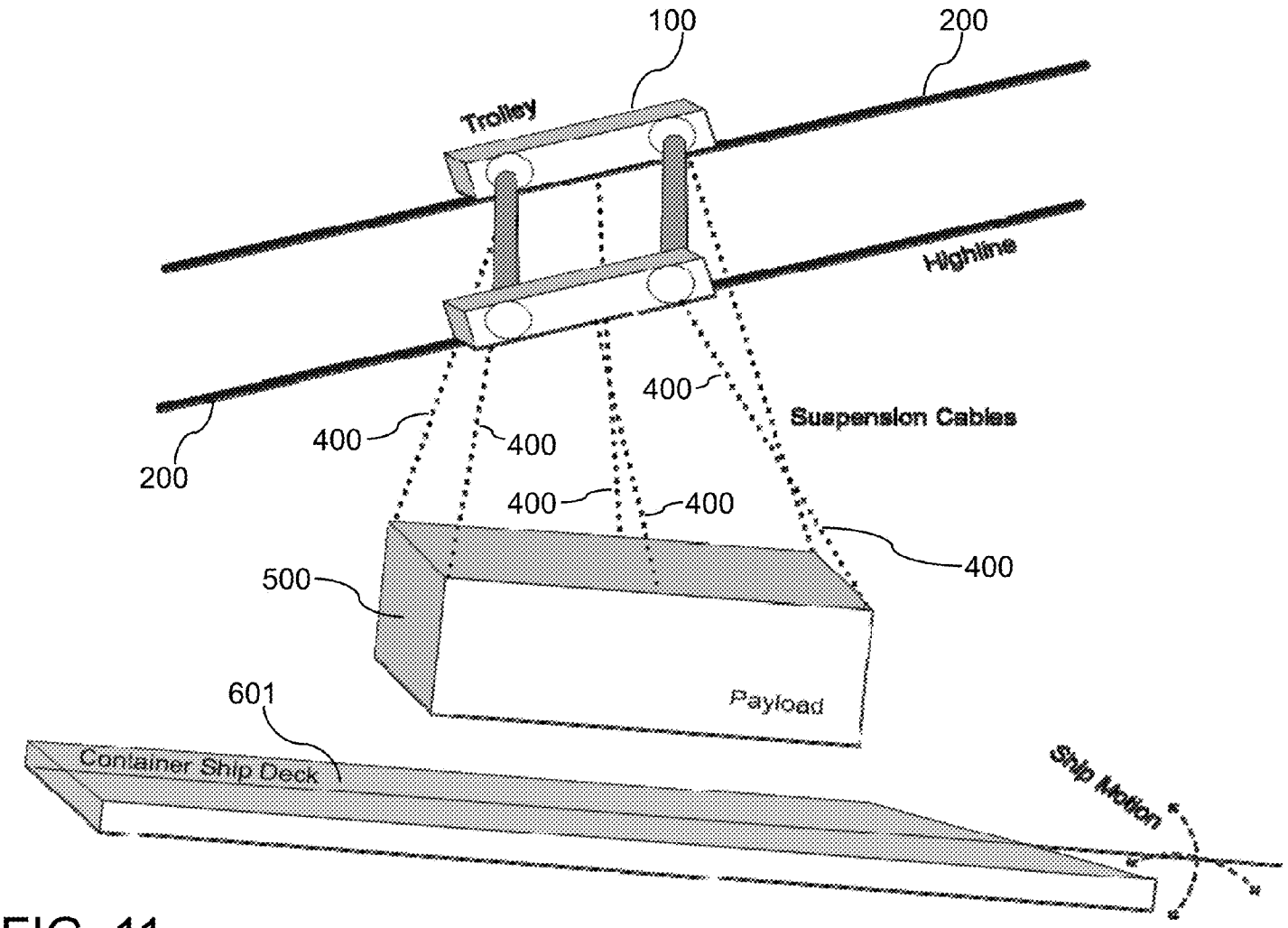
FIG. 11 is a similar but slightly different view of the inventive embodiment shown in FIG. 10.

With reference to FIG. 10 through FIG. 14, an embodiment of the present invention's system modeling is now described with reference to an inventive system characterized by six hoist lines 400. FIGS. 1, 3, 4, and 9 show each hoist line 400 attached at one end to a corner 123 of the trolley body 145 of trolley 100, and at the other end to a corner 523 of the payload container 502. In contrast, FIGS. 10 and 11 show four hoist lines 400 that are attached at one end to a trolley corner 123 and at the other end to a container corner 523, and two hoist lines 400 that are each attached at neither a trolley corner 123 nor a container corner 523. The skilled artisan who reads the instant disclosure will appreciate the ways in which the principles of inventive system modeling discussed herein are applicable to diverse embodiments of inventive transfer (e.g., UNREP) systems, including those characterized by four hoist lines 400 and those characterized by six hoist lines 400.

As depicted in FIG. 10, the inventive system includes a trolley 100, two generally parallel and generally coplanar highlines 200 of generally equal height, two haul lines 300, and six hoist lines 400 connecting trolley 100 with payload 500. The trolley 100, the six controllable hoist lines 400, and the payload 500 together represent a kind of inverted Stewart platform. Again, in the light of the instant disclosure, the skilled artisan will appreciate that the trolley 100, the four controllable hoist lines 400, and the payload 500 shown in FIG. 1 similarly represent together a kind of inverted Stewart platform. FIG. 10 and FIG. 11 are illustrative of how an inventive configuration may bear analogy to an inverted Stewart platform.

A typical inventive control system includes two major control subsystems, namely: (i) a trolley-movement controller for controlling the transporting of the load from one ship to the other while minimizing payload pendulation; and, (ii) a Stewart platform controller for controlling the payload motion orientation by maintaining proper tension on each suspension cable.

Trolley Control

The first main controller of this example of an inventive UNREP control system is the trolley trajectory controller. The trolley 100 transports the load from one ship 600 to the other. It is necessary to control the trolley 100 to counteract the randomness of ship 600 motion, as well as to "isolate" the noise from the load, in order to minimize random motion of payload 500 during UNREP operation. The design strategy for this controller will involve the regulated motion of the load by an Input-Shaping based controller, i.e. the S-curve profile.

Figure 12:
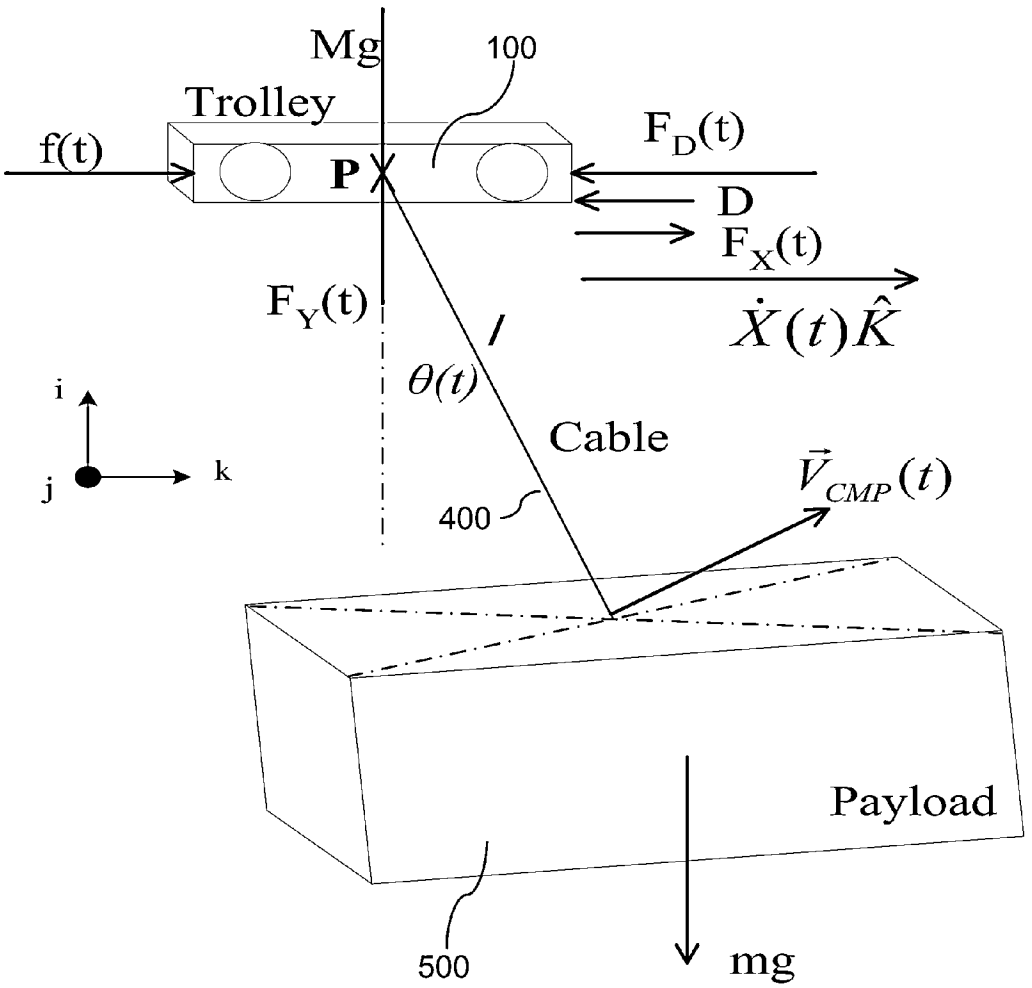
FIG. 12 is a free body diagram of an embodiment of an inventive trolley-and-payload system.

The free body diagram of trolley 100, payload 500, and the kinematics of payload pendulation motion is shown in FIG. 12. In the following mathematical example of trolley control modeling, the following notations are defined: $\vec{f}_D(t)$ is the frictional force between the trolley and the highline; $\vec{F}_X(t)$ is the X component of the reaction force at the pivot; $\vec{F}_Y(t)$ is the Y component of the reaction force at the pivot; $\vec{g}$ is the acceleration due to gravity; D is the friction force of the highline supporting trolley; $\vec{W}$ is the constant force of gravity on the payload; $\vec{X}(t)$ is the trolley position with respect to a reference point; l is the length of the cable; M is the mass of the trolley; m is the mass of the payload; f is the force applied to the trolley; θ is the angular displacement of the payload from vertical; R is the friction force at the pivot joint for load oscillation.

It is assumed that the triad of unit vectors $\{\hat{i},\hat{j},\hat{k}\}$ is fixed with respect to the highline. For the mass M of the trolley, Newton's Second Law is applied by summing the forces along the x-direction.

$$M\ddot{x}(t)=f(t)-D\dot{x}(t)+F_x(t) \tag{1.1}$$

Similarly, summing the forces on the payload gives:

$$\vec{F}_Y(t)+\vec{F}_X(t)=mg(-\hat{i})-F_X(t)\hat{k} \tag{1.2}$$

Let $\vec{V}_{CMP}(t)$ be the velocity of mass center with respect to point P, and $\dot{X}(t)\hat{k}$ is the velocity of point P with respect to inertial space.

$$X_{CMP}(t)=l\sin\theta\hat{k}+(l-l\cos\theta)\hat{i}==\dot{X}(t)\hat{k}+\vec{V}_{CMP}(t)=[l\dot{\theta}(t)\sin\theta(t)]\hat{i}+[\dot{X}(t)+l\dot{\theta}(t)\cos\theta(t)]\hat{k} \tag{1.3}$$

Differentiation of Equation (1.3) gives:

$$\vec{a}_{CMP}(t)=d\vec{V}_{CMP}(t)/dt=[l\ddot{\theta}(t)\sin\theta(t)+l\dot{\theta}^2(t)\cos\theta(t)]\hat{i}+[\ddot{X}(t)+l\ddot{\theta}(t)\cos\theta(t)-l\dot{\theta}^2(t)\sin\theta(t)]\hat{k} \tag{1.4}$$

The sum of all moments of the pivot contact forces is $$[lF_X(t)\cos\theta(t)+lF_Y(t)\sin\theta(t)-R\dot{\theta}(t)]\hat{j} \tag{1.5}$$

We proceed by comparing $\hat{i}$ and $\hat{k}$ components in (1.2) and (1.4), multiplying by m. This gives two scalar equations with respect to vector $\hat{i}$ and $\hat{k}$.

$$ml[\ddot{\theta}(t)\sin\theta(t)+\dot{\theta}^2(t)\cos\theta(t)]=-F_Y(t)-mg \tag{1.6}$$

$$m\ddot{X}(t)+ml\ddot{\theta}(t)\cos\theta-ml\dot{\theta}^2(t)\sin\theta(t)=-F_X(t) \tag{1.7}$$

It is assumed that the cable is straight under high tension. Then calculation of the moments of the forces with respect to the center of payload mass, and the sum of the moments of the pivot contact forces gives $$lF_X(t)\cos\theta(t)+lF_Y(t)\sin\theta(t)-R\dot{\theta}(t)=0 \tag{1.8}$$

Equations (1.1), (1.6), (1.7), and (1.8) describe the dynamics of this crane system. Solve $F_X(t)$,$F_Y(t)$ from equations (1.6) and (1.7), and substitute them into equations (1.1) and (1.8). This gives:

$$f(t)-D\dot{X}(t)+ml\dot{\theta}^2(t)\sin\theta(t)=(M+m)\ddot{X}(t)+ml\cos\theta(t)\ddot{\theta}(t) \tag{1.9}$$

$$ml^2\ddot{\theta}(t)+ml\cos\theta(t)\ddot{X}(t)=-mgl\sin\theta(t)-R\dot{\theta}(t) \tag{1.10}$$

Linear models are good approximations as long as the pendulation angles are small and the frequencies of all present base excitations are away from the natural frequency of the cable-payload assembly. Thus, for small-angle payload motion, the inventive system model given by Equations (1.9) and (1.10) simplifies to:

$$(M+m)\ddot{X}+D\dot{X}+ml\ddot{\theta}=f(t) \tag{1.11}$$

$$ml^2\ddot{\theta}+ml\ddot{X}+mgl\theta+R\dot{\theta}=0 \tag{1.12}$$

$$f(t)=-\alpha_3\alpha_1\alpha x-\alpha_2\alpha\dot{x}+\alpha\alpha_1 u(t) \tag{1.13}$$

Figure 13:
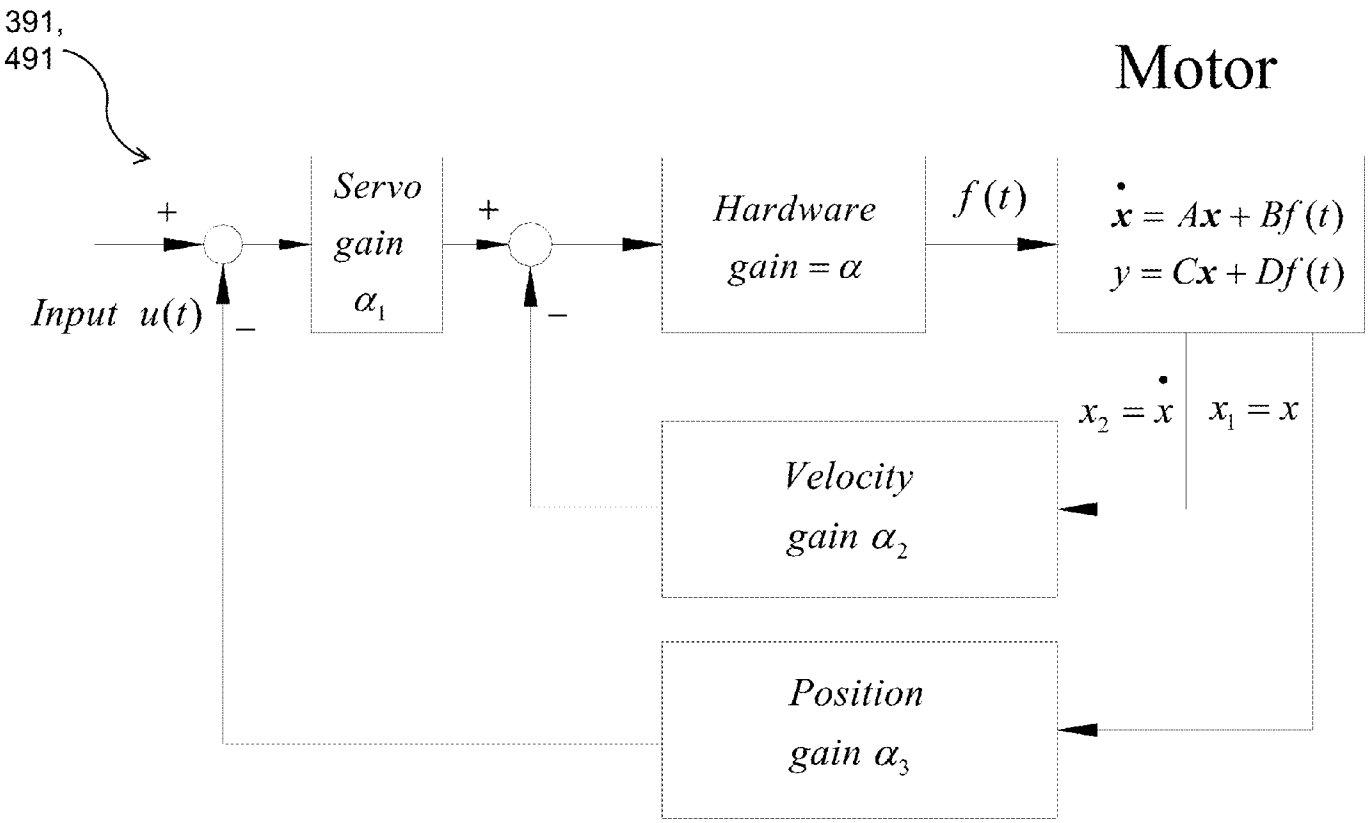
FIG. 13 is a block diagram of an embodiment of an inventive trolley-and-payload system.

A typical trolley-payload system block diagram is shown in FIG. 13. Equation (1.13) is an example of a mathematical expression of a trolley-payload system in accordance with the present invention.

State variables are defined thusly: $x_1=x$; $x_2=\dot{x}$; $x_3=\theta$; $x_4=\dot{\theta}$. H is the constant diffusion coefficient, and $\eta$ is the external disturbance arising from wave motions. $\gamma$ represents the position of the load with respect to a fixed reference point, and $\xi$ represents the measurement noise. Then Equations (1.11), (1.12), and (1.13) can be expressed in state space form as:

$$\begin{pmatrix}\dot{x}_1\\ \dot{x}_2\\ \dot{x}_3\\ \dot{x}_4\end{pmatrix}=\begin{pmatrix}0 & 1 & 0 & 0\\ -\frac{\alpha\alpha_1\alpha_3}{M} & -\frac{\alpha\alpha_2+D}{M} & \frac{mg}{M} & \frac{R}{Ml}\\ 0 & 0 & 0 & 1\\ \frac{\alpha\alpha_1\alpha_3}{Ml} & \frac{\alpha\alpha_2+D}{Ml} & -\frac{g}{l}\frac{M+m}{M} & -\frac{R(M+m)}{mMl^2}\end{pmatrix}\begin{pmatrix}x_1\\ x_2\\ x_3\\ x_4\end{pmatrix}+\begin{pmatrix}0\\ \frac{\alpha\alpha_1}{M}\\ 0\\ -\frac{\alpha\alpha_1}{Ml}\end{pmatrix}u+H\eta \tag{1.14}$$

$$y=(1\ 0\ l\ 0)\begin{pmatrix}x_1\\ x_2\\ x_3\\ x_4\end{pmatrix}+\xi$$

Equation (1.14) can be used to design the linear stochastic controller.

Hoist Control

The second controller of this inventive embodiment of an UNREP control system is a controller of the hoisting lines. This controller, in principle, is a kind of suspension cable tension controller for an inverted Stewart platform.

The inverted Stewart platform uses multiple point payload suspension and uses the differential between the tension forces in the various suspension cables to dampen the payload pendulation and manipulate the orientation. This design enhances stiffness of the cable-payload system, and thus it is more resistant to pendulation. This control design approach mandates a rigid body payload motion rather than a point mass. Furthermore, the multiple cable suspension inverted Stewart platform will fully control the motion orientation of the payload to mimic the prescribed container ship motion.

Figure 14:
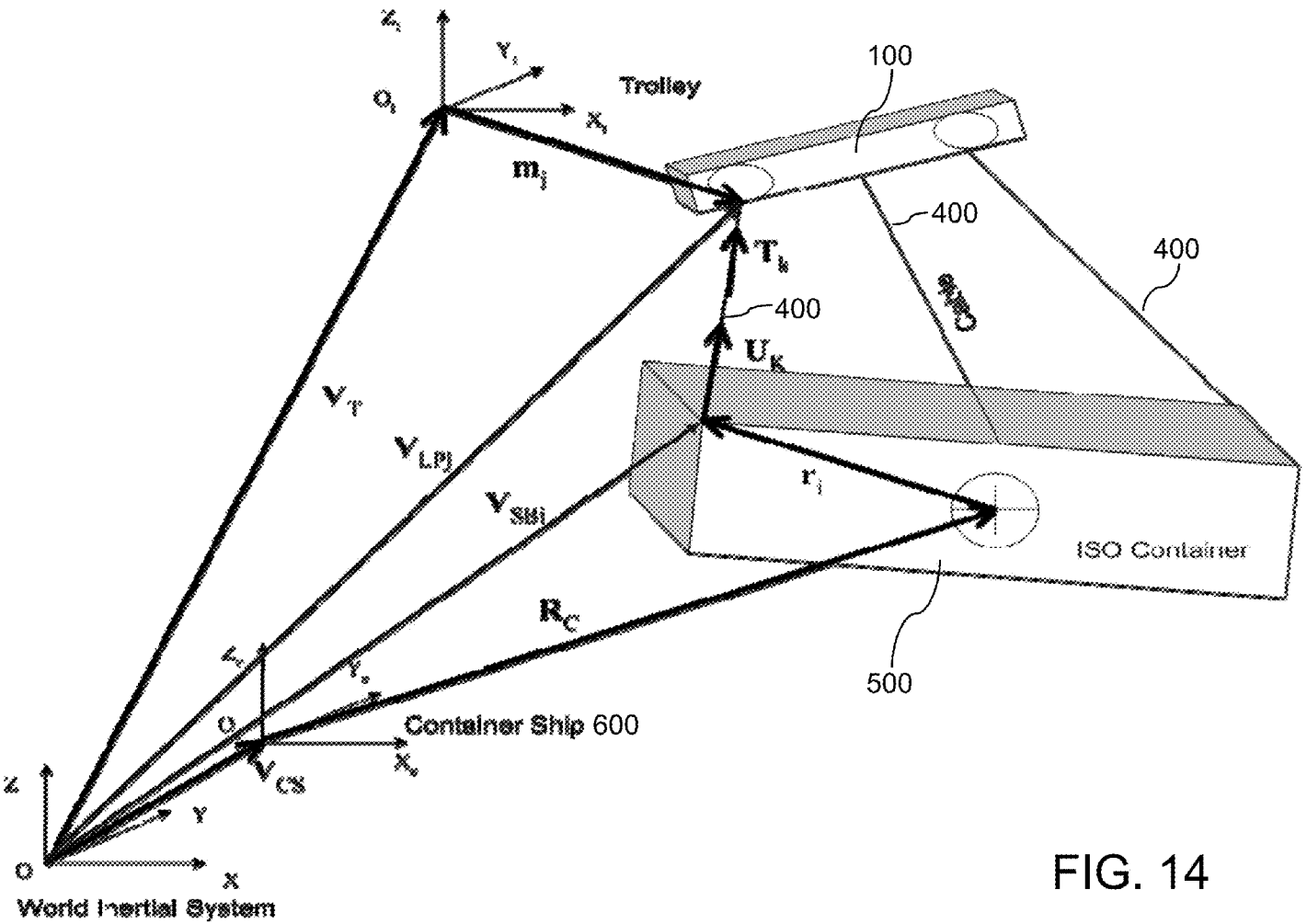
FIG. 14 is a conceptual diagram of coordinate systems and vectors relating to an embodiment of an inventive trolley-and-payload system.

The coordinate systems and vectors are shown in FIG. 14. The coordinate systems are assumed to have coincident origins at all times during the rotational transformation matrices development. The coordinate system O–XYZ is fixed in inertial space, and a second body fixed moving coordinate system $O_c$–$x_cy_cz_c$, is initially coincident with the inertial system. The coordinate system $o_c$–$x_cy_cz_c$ is considered to move away from alignment with O–XYZ, as the rotations $\theta_x$, $\theta_y$ and $\theta z$ occur.

Equation (1.15) maps the body coordinates (x, y, z) to the spatial points (X,Y,Z).

$$\begin{Bmatrix}X\\ Y\\ Z\end{Bmatrix}=\begin{bmatrix}\cos\theta_z\cos\theta_y & -\sin\theta_z\cos\theta_x+\cos\theta_z\sin\theta_y\sin\theta_x & \sin\theta_z\sin\theta_x+\cos\theta_z\sin\theta_y\cos\theta_x\\ \sin\theta_z\cos\theta_y & \cos\theta_z\cos\theta_x+\sin\theta_z\sin\theta_y\sin\theta_x & -\cos\theta_z\sin\theta_x+\sin\theta_z\sin\theta_y\cos\theta_x\\ -\sin\theta_y & \cos\theta_y\sin\theta_x & \cos\theta_y\cos\theta_x\end{bmatrix}\begin{Bmatrix}x\\ y\\ z\end{Bmatrix}$$
$$=[G_z][G_y][G_x]\{x\}$$
$$=[G]\begin{Bmatrix}x\\ y\\ z\end{Bmatrix} \tag{1.15}$$

Then the angular velocity, when resolved on the world coordinate, is $$\Omega=\dot{\theta}_x\begin{Bmatrix}1\\ 0\\ 0\end{Bmatrix}+\dot{\theta}_y\begin{Bmatrix}0\\ \cos\theta_x\\ \sin\theta_x\end{Bmatrix}+\dot{\theta}_z\begin{Bmatrix}\cos\theta_x\sin\theta_y\\ -\sin\theta_x\\ \cos\theta_x\cos\theta_y\end{Bmatrix} \tag{1.16}$$

and the angular acceleration, as seen in the world coordinate, is $$a=\ddot{\theta}_x\begin{Bmatrix}1\\ 0\\ 0\end{Bmatrix}+\ddot{\theta}_y\begin{Bmatrix}0\\ \cos\theta_x\\ \sin\theta_x\end{Bmatrix}+\ddot{\theta}_z\begin{Bmatrix}\cos\theta_x\sin\theta_y\\ -\sin\theta_x\\ \cos\theta_x\cos\theta_y\end{Bmatrix}+\dot{\theta}_x\dot{\theta}_y\begin{Bmatrix}0\\ -\sin\theta_x\\ \cos\theta_x\end{Bmatrix}+\dot{\theta}_x\dot{\theta}_z\begin{Bmatrix}-\sin_x\sin\theta_y\\ -\cos\theta_x\\ -\sin\theta_x\cos\theta_y\end{Bmatrix}+\dot{\theta}_y\dot{\theta}_z\begin{Bmatrix}\cos\theta_x\cos\theta_y\\ 0\\ -\cos\theta_x\sin\theta_y\end{Bmatrix} \tag{1.17}$$

A vector along the $k^{th}$ cable is defines by the vector difference as shown in FIG. 14.

$$\{d_k\}_{(Worldcomponent)}=V_{LPj}-V_{SBi}=\begin{Bmatrix}V_{TX}\\ V_{TY}\\ V_{TZ}\end{Bmatrix}+[G_{Trolley}]\begin{Bmatrix}m_{txj}\\ m_{tyj}\\ m_{tzj}\end{Bmatrix}-\begin{Bmatrix}V_{CSX}\\ V_{CSY}\\ V_{CSZ}\end{Bmatrix}+[G_{CS}]\begin{Bmatrix}x_C+x_i\\ y_C+y_i\\ z_C+z_i\end{Bmatrix} \tag{1.18}$$

Equation (1.18) could be normalized to give a unit vector in the same direction.

$$\{u_k\}_{(World\ coordinate)}=\frac{1}{|\{d_k\}|}\{d_k\} \tag{1.19}$$

The tensions are $T_k$ for $k^{th}$ cable will be $$\{u_k\}_{(World\ coordinate)} = \frac{1}{|\{d_k\}|}\{d_k\} \tag{1.20}$$

The calculation of the moment vector due to all of the tensions:

$$\begin{aligned}\begin{Bmatrix} M_x \\ M_y \\ M_z \end{Bmatrix} &= \sum_{k=1}^{6} r_i \times T_k \\ &= \sum_{k=1}^{6} T_k [r_i \otimes][G_{CS}]^{-1}\{u_k\} \\ &= \underbrace{[[r_i \otimes][G_{CS}]^{-1}\{u_k\}]}_{3\times 6}\underbrace{\{T_k\}}_{6\times 1}\end{aligned} \tag{1.21}$$

where ⊗ denotes the standard cross product between two vectors.

The origin of the coordinate system fixed on the container ship, $o_c$–$x_c y_c z_c$, displaces with a known motion $V_{cs}(t)$. The location of the container in this coordinate system is given by a known constant vector $\{R_c\}$. Newton's second law is then applied to the motion of the center of mass of the container.

$$\sum F = \frac{1}{g} W a \tag{1.22}$$

$$\begin{aligned}\sum_{k=1}^{6} T_k\{u_k\} + \begin{Bmatrix} 0 \\ 0 \\ -W \end{Bmatrix} &= \\ \frac{W}{g}\underbrace{(\{V_{CS}\} + [a \otimes]\{R_C\} + [\Omega \otimes][\Omega \otimes]\{R_C\})}_{acceleration}\underbrace{[\{u_k\}]}_{3\times 6}\underbrace{\{T_k\}}_{6\times 1} &= \\ \frac{W}{g}(\{V_{CS}\} + [a \otimes]\{R_C\} + [\Omega \otimes][\Omega \otimes]\{R_C\}) + \begin{Bmatrix} 0 \\ 0 \\ -W \end{Bmatrix}\end{aligned} \tag{1.23}$$

After the angular velocity and acceleration components are calculated, Euler's equations can then be used to evaluate the moments acting on the body:

$$\begin{Bmatrix} M_x \\ M_y \\ M_z \end{Bmatrix} = \begin{Bmatrix} I_x\dot{\omega}_x - \omega_y\omega_z(I_y - I_z) \\ I_x\dot{\omega}_y - \omega_z\omega_x(I_z - I_x) \\ I_x\dot{\omega}_z - \omega_x\omega_y(I_x - I_y) \end{Bmatrix} \tag{1.24}$$

Cable tension can be calculated by solving a set of simultaneous linear equation (1.23) and (1.24). Manipulation of the tension applied on each cable would mimic the container's orientation to the container ship motion.

The haul-control computer can be designed as a trajectory-following controller for minimization of cargo pendulation, and can be based on stochastic control theory, to drive the trolley. This trolley-derived controller can be implemented in state feedback linearization in conjunction with a Kalman filter. The hoist-control computer can be designed as a cable tension controller, and can be based on calculations pertaining to an inverted Stewart platform. The skilled artisan who reads the instant disclosure will understand that inventive control of trolley hauling and inventive control of payload hoisting can each be practiced in various ways in accordance with the present invention.

The present invention, which is disclosed herein, is not to be limited by the embodiments described or illustrated herein, which are given by way of example and not of limitation. Other embodiments of the present invention will be apparent to those skilled in the art from a consideration of the instant disclosure, or from practice of the present invention. Various omissions, modifications, and changes to the principles disclosed herein may be made by one skilled in the art without departing from the true scope and spirit of the present invention, which is indicated by the following claims.

What is claimed is:

1. Cargo conveyance apparatus comprising:

a track including at least two generally parallel tensioned flexible lines, said track characterized by a length, two opposite track ends, and two opposite longitudinal directions, said opposite track ends being a first track end and a second track end, said opposite longitudinal directions being a positive longitudinal direction and a negative longitudinal direction; said positive longitudinal direction being toward said first track end, said negative longitudinal direction being toward said second track end;

a vehicle having a vehicular body and at least four wheels, said vehicular body characterized by a first vehicular end, a second vehicular end, an approximately rectangular plan shape and four vehicular corners, said four vehicular corners corresponding to said approximately rectangular plan shape, said at least four wheels arranged so as to include at least two axial pairs of said wheels, a first said wheel situated at a first said vehicular corner, a second said wheel situated at a second said vehicular corner, a third said wheel situated at a third said vehicular corner, a fourth said wheel situated at a fourth said vehicular corner, the first said wheel and the second said wheel being axially paired, the third said wheel and the fourth said wheel being axially paired, the first said wheel and the third said wheel each engaging a first said line, the second said wheel and the fourth said wheel each engaging a second said line, said vehicle being movable via said at least four wheels along and atop said track in said positive longitudinal direction and said negative longitudinal direction;

a pair of vehicle winching mechanisms, for regulating said motion of said vehicle along and atop said track in said positive longitudinal direction and said negative longitudinal direction, a first said vehicle winching mechanism being situated at said first track end, a second said vehicle winching mechanism being situated at said second track end, each said vehicle winching mechanism including a hauling cable, a first said hauling cable being included in said first vehicle winching mechanism and connected to said vehicular body at said first vehicular end, a second said hauling cable being included in said second vehicle winching mechanism and being connected to said vehicular body at said second vehicular end;

a payload container, for containing payload contents, said payload container characterized by four container corners and an approximately rectangular-prismatic shape;

four payload winching mechanisms, for regulating the pendulation of a payload suspended from said vehicle, said payload including said payload container and any said payload contents, each said payload winching mechanism including a hoisting cable, said hoisting cables connected to said vehicular body at said four vehicular corners and connected to said payload container at said four container corners;

a computer for controlling said payload winching mechanisms, said computer being configured to execute pendulation-control computer program logic that, when executed, is capable of controlling said pendulation of said container, wherein according to said pendulation-control computer program logic the combination including said vehicle, said payload winching mechanisms, and said payload essentially constitutes an inverted Stewart platform and said payload container essentially constitutes a rigid body, said payload suspended from said vehicle via said payload winching mechanisms, said computer implementing a differential between the respective tensions of said hoisting cables and independently controlling the respective said tensions of said hoisting cables so as to move said payload in any of six degrees of freedom and thereby change the position, or orientation, or both position and orientation, of said payload, wherein effectuation of said inverted Stewart platform is furthered by said approximately rectangular plan shape of said vehicle, said approximately rectangular-prismatic shape of said payload container, and the respective connections of said hoisting cables at said four vehicular corners and said four container corners.

2. The cargo conveyance apparatus of claim 1 wherein:

said first track end is situated onboard a first marine vessel;

said second track end is situated onboard a second marine vessel.

3. The cargo conveyance apparatus of claim 1 further comprising a computer for controlling said vehicle winching mechanisms, said computer being configured to execute vehicle-movement computer program logic that, when executed, is capable of causing said vehicle to move in said positive longitudinal direction or said negative longitudinal direction, wherein according to said vehicle-movement computer program logic said vehicle winching mechanisms are capable of operating in tandem whereby one said vehicle winching mechanism impels said vehicle while the other said vehicle winching mechanism restrains said vehicle.

4. A transport system suitable for use between ships at sea, the transport system comprising:

two generally parallel tensioned flexible highline cables extending between a first location and a second location, said highline cables being a left highline cable and a right highline cable;

a trolley situated upon and movable along said highline cables, said trolley having a trolley body, a left front wheel, a right front wheel, a left back wheel, a right back wheel, a front trolley end, and a back trolley end, said trolley body characterized by an approximately rectangular plan profile and four trolley corners corresponding to said approximately rectangular plan profile, said left front wheel situated at the left front said trolley corner, said left back wheel situated at the left back said trolley corner, said right front wheel situated at the right front said trolley corner, said right back wheel situated at the right back said trolley corner, said left front wheel and said right front wheel being coaxially joined, said left back wheel and said right back wheel being coaxially joined, said left front wheel and said left back wheel each rotatably engaging said left highline cable, said right front wheel and said right back wheel each rotatably engaging said right highline cable;

four payload-hoist winches, said payload-hoist winches being a left front payload-hoist winch situated at the left front said trolley corner, a left back payload-hoist winch situated at the left back said trolley corner, a right front payload-hoist winch situated at the right front said trolley corner, and a right back payload-hoist winch situated at the right back said trolley corner;

a payload container characterized by a box-like shape and four container corners;

four payload-hoist cables respectively associated with said payload-hoist winches and respectively connected to said payload container at said container corners, a left front said payload-hoist cable associated with said left front hoisting winch and connected at the left front said container corner, a left back said payload-hoist cable associated with said left back payload-hoist winch and connected at the left back said container corner, a right front said payload-hoist cable associated with said right front said payload-hoist winch and connected at the right front said container corner, a right back said payload-hoist cable associated with said right back said payload-hoist winch and connected at the right back said container corner;

a computer communicating with said payload-hoist winches and configured to execute payload-pendulation control computer program logic including implementation of a differential between the respective said tensions of said payload-hoist cables and including independent change of each of the respective tensions of said payload-hoist cables, thereby effecting continual six-degrees-of-freedom adjustment of at least one of the position and orientation of said payload container, said payload-pendulation control computer program logic being based on an inverted Stewart platform model describing suspension, via said payload-host cables, of said payload container from said trolley body wherein said payload container represents a rigid body, wherein implementation of said inverted Stewart platform is facilitated by said approximately rectangular plan profile of said trolley, said box-like shape of said payload container, and the respective connections of said payload-hoist cables at said four trolley corners and said four container corners;

two trolley-movement winches respectively situated at said first location and said second location;

two trolley-movement cables respectively associated with said trolley-movement winches and respectively connected at said front trolley end and said back trolley end, wherein each said trolley-movement winch, together with its associated trolley-movement cable, is capable of exerting a pulling force on said trolley so as to impel said trolley along said highline cables.

5. The transport system of claim 4 wherein said trolley-movement winches, together with their respectively associated trolley-movement cables, cooperatively act to propel said trolley along said highline cables, the transport system further comprising a computer communicating with said trolley-movement winches and configured to execute trolley-movement control computer program logic whereby said trolley is controllably moved along said highline cables, wherein according to said trolley-movement control computer program logic:

if the pulling force exerted by said trolley-movement winch situated at said second location is substantially in the nature of a motivating force, then the pulling force exerted by said trolley-movement winch situated at said first location is substantially in the nature of a restraining force;

if the pulling force exerted by said trolley-movement winch situated at said first location is substantially in the nature of a motivating force, then the pulling force exerted by said trolley-movement winch situated at said second location is substantially in the nature of a restraining force;

said trolley-movement winches, together with their respectively associated trolley-movement cables, cooperatively act to propel said trolley either toward said second location or toward said first location.

6. The transport system of claim 5 wherein said first location is on a first ship, and said second location is on a second ship.

7. The transport system of claim 4 wherein said first location is on a first ship, and said second location is on a second ship.

8. The transport system of claim 7 wherein said trolley-movement winches, together with their respectively associated trolley-movement cables, cooperatively act to propel said trolley along said highline cables, the transport system further comprising a computer communicating with said trolley-control winches and configured to execute trolley-movement control computer program logic whereby said trolley is controllably moved along said highline cables, wherein according to said trolley-movement control computer program logic:

the pulling force exerted by said trolley-movement winch situated at said first location is substantially in the nature of a restraining force;

the pulling force exerted by said trolley-movement winch situated at said second location is substantially in the nature of a motivating force;

said trolley-movement winches, together with their respectively associated trolley-movement cables, cooperatively act to propel said trolley away from said first location and toward said second location.

9. The transport system of claim 4 wherein:

said highline cables are a first left highline cable and a first right highline cable;

two additional generally parallel tensioned flexible highline cables extend between said first location and said second location, said two additional generally parallel tensioned flexible highline cables being a second left highline cable and a second right highline cable;

said left front wheel is a first left front wheel;

said right front wheel is a first right front wheel;

said left back wheel is a first left back wheel;

said right back wheel is a first right back wheel;

said trolley additionally has a second left front wheel, a second right front wheel, a second left back wheel, and a second right back wheel;

said first left front wheel and said first left back wheel each rotatably engage said first left highline cable;

said first right front wheel and said first right back wheel each rotatably engage said first right highline cable;

said second left front wheel and said second left back wheel each rotatably engage said second left highline cable;

said second right front wheel and said second right back wheel each rotatably engage said second right highline cable.

10. The transport system of claim 4 wherein two additional hoisting cables are connected to said trolley body, and wherein neither of said additional hoisting cables is connected to said trolley body at a said trolley corner.

11. The transport system of claim 8 wherein:

said highline cables are a first left highline cable and a first right highline cable;

two additional generally parallel tensioned flexible highline cables extend between said first location and said second location, said two additional generally parallel tensioned flexible highline cables being a second left highline cable and a second right highline cable;

said left front wheel is a first left front wheel;

said right front wheel is a first right front wheel;

said left back wheel is a first left back wheel;

said right back wheel is a first right back wheel;

said trolley additionally has a second left front wheel, a second right front wheel, a second left back wheel, and a second right back wheel;

said first left front wheel and said first left back wheel each rotatably engage said first left highline cable;

said first right front wheel and said first right back wheel each rotatably engage said first right highline cable;

said second left front wheel and said second left back wheel each rotatably engage said second left highline cable;

said second right front wheel and said second right back wheel each rotatably engage said second right highline cable.

12. The cargo conveyance apparatus of claim 1 wherein:

said track includes at least three said generally parallel tensioned flexible lines, wherein two said generally parallel tensioned lines are lateral lines and at least one said generally parallel tensioned flexible line is an intermediate said line;

said vehicle has at least five said wheels;

at least one said wheel engages at least one said intermediate line.

13. The cargo conveyance apparatus of claim 1 wherein:

said vehicle has at least a third said axial pair of said wheels;

the at least said third axial pair of said wheels includes at least a fifth said wheel and at least a sixth said wheel;

the at least said fifth said wheel engages the first said line;

the at least a sixth said wheel engages the second said line.

14. The cargo conveyance apparatus of claim 1 wherein:

said track includes a third said generally parallel tensioned flexible line and a fourth said generally parallel tensioned flexible line;

said vehicle has at least a third said axial pair of said wheels;

the at least said third axial pair of said wheels includes at least a fifth said wheel and at least a sixth said wheel;

the at least said fifth wheel engages the third said line;

the at least said sixth wheel engages the fourth said line.

15. A system for transporting cargo, the system comprising:

a trolley track including two parallel flexible cables respectively connected at opposite ends to two separate structures, said structures being a first said structure and a second said structure;

a trolley having two trolley ends, four trolley corners, and four wheels respectively situated at said trolley corners, said wheels engaging said trolley track so that said trolley is capable of riding upon said trolley track toward the first said structure or the second said structure;

a cargo container having four container corners;

two trolley-hauling devices each including a hauling winch and a hauling cable associated with said hauling winch, a first said hauling winch coupled with the first said structure, a second said hauling winch coupled with the second said structure, said hauling cables respectively attached to said trolley at said trolley ends, said trolley-hauling devices being capable of moving said trolley toward either the first said structure or the second said structure;

four payload-hoisting devices each including a hoisting winch and a hoisting cable associated with said hoisting winch, said hoisting winches respectively situated at said four trolley corners, said hoisting cables respectively attached to said cargo container at said container corners;

a computer communicating with said payload-hoisting devices and configured to execute computer program logic for effecting stabilization control of said cargo container either with or without cargo contained therein, said stabilization control being characterized by an inverted Stewart platform system according to which said cargo container: is suspended from said trolley by said hoisting cables; represents a rigid body; and is repositioned and/or reoriented in six degrees of freedom based on a differential between the respective tensions of said hoisting cables and through adjustment of at least one of the respective said tensions of said hoisting cables.

16. The system for transporting cargo of claim 15, wherein said stabilization representing an inverted Stewart platform system is facilitated by the respective situations of said hoisting winches at said trolley corners and the respective attachments of said hoisting cables at said container corners.

17. The system for transporting cargo of claim 15, wherein said structures are marine vessels.

18. The system for transporting cargo of claim 17, wherein said stabilization representing an inverted Stewart platform system is facilitated by the respective situations of said hoisting winches at said trolley corners and the respective attachments of said hoisting cables at said container corners.

19. The system for transporting cargo of claim 15, further comprising a computer communicating with said trolley-hauling devices and configured to execute computer program logic for controlling said movement of said trolley toward either the first said structure or the second said structure, said control of said movement of said trolley including coordination of tugging forces respectively exerted by said trolley-hauling devices.

20. The system for transporting cargo of claim 19, wherein said structures are marine vessels, and wherein said stabilization representing an inverted Stewart platform system is facilitated by the respective situations of said hoisting winches at said trolley corners and the respective attachments of said hoisting cables at said container corners.

* * * * *